US005715694A

United States Patent [19]

Yakumaru et al.

[11] Patent Number: 5,715,694

[45] Date of Patent: Feb. 10, 1998

[54] REFRIGERATOR CONTROLLER

[75] Inventors: Yuichi Yakumaru, Otsu; Shinji Watanabe, Kuritagun; Akira Fujitaka, Otsu; Yoshinori Kobayashi, Moriyama, all of Japan

[73] Assignee: Matsushita Electric Industrial Co., Ltd., Osaka, Japan

[21] Appl. No.: 653,337

[22] Filed: May 24, 1996

[30] Foreign Application Priority Data

May 26, 1995 [JP] Japan ..... 7-127852

[51] Int. Cl.[6] ..... F25B 41/00; F25B 1/00

[52] U.S. Cl. ..... 62/210; 62/223; 62/502

[58] Field of Search ..... 62/222, 210, 502, 62/223

[56] References Cited

U.S. PATENT DOCUMENTS

| | | | |
|---|---|---|---|
| 4,722,195 | 2/1988 | Suzuki et al. | 62/502 X |
| 4,840,042 | 6/1989 | Ikoma et al. | 62/502 X |
| 4,913,714 | 4/1990 | Ogura et al. | 62/149 |

FOREIGN PATENT DOCUMENTS 2-46863 10/1990 Japan .

*Primary Examiner*—William E. Wayner

*Attorney, Agent, or Firm*—Ratner & Prestia

[57] ABSTRACT

A refrigerator controller employs a non-azeotropic mixture refrigerant and a compressor, a four-way valve, an outdoor hear exchanger, a fractionator, an overhead condenser provided on the top of the fractionator, a first flow control valve, a throttle, and an indoor heat exchanger which are connected in the form of a ring. The controller further employs a circuit at a lower part of the fractionator returning to the bottom of the fractionator through a second flow control valve and a reheater, and a circuit returning from the overhead condenser to the top of the fractionator, thereby controlling the openings of the first and second flow control valves by the output signal of indoor and outdoor heat exchanger temperature detectors, an indoor temperature detector, and an indoor temperature setting device through a flow controller. In this manner, a wider control range of refrigerating capability can be realized. Thus a high separation effect for mixed refrigerant components is obtained while controlling a safe and optimum refrigerant cycle.

21 Claims, 36 Drawing Sheets

REFRIGERATOR CONTROLLER

FIELD OF THE INVENTION

This invention relates to a refrigerator controller employing a mixed non-azeotropic refrigerant realizing an optimum refrigerating cycle while securing a wider range of control capability.

BACKGROUND OF THE INVENTION

FIG. 37 shows a refrigerating cycle for a refrigerator realized by using a conventional mixed non-azeotropic refrigerant. As shown in FIG. 37, this refrigerating cycle of the refrigerator is realized by connecting compressor 101, condenser 102, vapor-liquid separator 103, heat-exchanger 104, throttle device 105, and evaporator 106 in the form of a ring, and is provided further with a returning circuit from the bottom of the vapor-liquid separator 103 to compressor 101 through throttle 107 and heat exchanger 104.

In the above-shown refrigerator controller structure, the refrigerant vapor compressed by compressor 101 is partially condensed by condenser 102, and is separated into a vapor component containing more of the low boiling point component and a liquidized refrigerant containing more of the high boiling point component. The cooling effect is produced by the evaporation of the liquid by throttle 107 and by the evaporation thereof within heat-exchanger 104 condensing the vapor separated by vapor-liquid separator 103. The condensed liquid is expanded by throttle device 105 and is evaporated by evaporator 106 lowering the temperature thereof.

However, with the above-described structure of a conventional refrigerator controller, the ratio of the low boiling point component contained in the refrigerant vapor separated by vapor-liquid separator 103 has to be set at a high value in order to obtain a higher temperature by condenser 102 while obtaining a lower temperature by condenser 106. However, with the above-shown structure, only a component ratio attaining an equilibrim between the temperature and the temperature within liquid-vapor separator 103 can be obtained.

Thus, a serial connection of plural liquid-vapor separators and plural partial condensers had been known as an only means to increase the composition of low-boiling components in the vapor. However, this means had been known to be definitely disadvantageous since this complicated device can be obtained only by a considerable sacrifice of high-cost liquid-vapor separators and heat exchangers. Moreover, whereas the problems of low compressor efficiency due to the refrigerant leakage taking place during this process starting from the intake to the blowout of compressor and low coefficient of performance (COP) due to the low volumetric efficiency possible with the low frequency range, had been left unsolved, a new method for controlling the capability of a refrigerator has been strongly desired. In addition to these, the problem of exact control of refrigerator capability in accordance to the magnitude of load is more difficult to solve.

SUMMARY OF THE INVENTION

An object of the present invention is to attain a higher separation efficiency of mixed refrigerant components by using a safe and high COP refrigerator of simple construction, an optimum refrigerating cycle matched to the required load, and a wider control range of refrigerator capability.

A refrigerator controller in accordance with the present invention employs a mixed non-azeotropic refrigerant and a refrigerating cycle consisting of a variable-volume compressor, fractionator, flow-control valve, throttle device, and an evaporator which are connected in the form of a ring. The controller further employs either a reheater or overhead condenser, or both positioned between the fractionator and the flow control-valve. The controller further employs circulating circuits of the fractionator and a condenser temperature detecting means for detecting the temperature of the condenser, an atmospheric temperature detecting means for detecting the atmospheric temperature of the condenser which coresponds to the room-temperature, a room-temperature setting means for setting the room-temperature at a desired temperature, and a flow valve controller provided with a microcomputer. The microcomputer is used for comparing the outputs of the condenser temperature detecting means, room temperature detecting means and room temperature setting means, outputting a predetermined refrigerant flow-control mode, and controlling the flow-control valve according to the condenser temperature, room-temperature and the preset room-temperature through the flow-control valve control means. Thus, while detecting any abnormal increases of condenser pressure and indoor-load, the refrigerant components and the flow in the refrigerant cycle become controllable, thereby avoiding any abnormal pressure increases, an optimum refrigerating cycle of high COP matched to the required load is realized.

In accordance with a first exemplary embodiment of the present invention, a mixed non-azeotropic refrigerant is used as the refrigerant. The first exemplary embodiment employs a refrigerating cycle constructed by ring-connecting a variable volume compressor, condenser, fractionator, reheater provided on the bottom of the fractionator, flow-control valve, throttle device, and evaporator. The refrigerant evaporated by the reheater is separated into two circuits, one of which is connected to a returning circuit to the bottom of the fractionator and the other is connected to a circuit connected to the flow-control valve. The first exemplary embodiment is provided further with a condenser-temperature detecting means and a flow-control valve controlling means, wherein the flow-control valve controlling means is comprised of a comparison means for comparing the condenser-temperature derived from the condenser temperature detecting means with the predetermined condenser temperature and outputting the result of the comparison. The first exemplary embodiment further employs a memory means for memorizing the output-modes controlling the opening of the flow-control valve and a selection means for selecting one of the out modes memorized in the memory means according to the control-signal from the flow-control valve by a control-signal obtained from the comparison means. Thus, any abnormal pressure increases of condenser can be detected by detecting abnormal condenser temperature increases and by controlling the opening of the flow-control valve.

A second exemplary embodiment of the present invention employs a mixed non-azeotropic refrigerant as the refrigerant, and uses a refrigerant cycle constructed by a variable-volume compressor, four-way valve, outdoor heat-exchanger, fractionator, reheater provided on the bottom of the fractionator, flow-control valve, throttle device, and an outdoor heat-exchanger which are serially connected in the form of a ring. The refrigerant evaporated by the reheater is separated into two circuits, one of which is connected to a returning circuit to the bottom of the fractionator and the other is connected to a circuit connected to the flow-control valve. The second exemplary embodiment is provided further with an outdoor and indoor condenser temperature detecting means for detecting the respective temperatures, an operating-mode detector for detecting the operating mode, and a means to control the flow-control valve. The flow-control valve control means is provided with a first comparison means for comparing the temperature of outdoor heat-exchanger obtained from the outdoor heat-exchanger temperature detecting means with the predetermined outdoor heat-exchanger temperature, a second comparison means for comparing the temperature of indoor heat exchanger obtained by the indoor heat-exchanger temperature detecting means with the predetermined temperature of indoor heat exchanger and outputting the result of it, a third comparison means for comparing the value detected by the operation-mode detecting means with the preset value of operation-mode, a memory means for memorizing the output-modes controlling the opening of the flow control valve, a selecting means for selecting one of the output modes memorized in the memory means according to the signal outputted from the first to third comparison means, and an output means for outputting a signal of the selection means according to the first to third comparison means, controlling the opening of the flow control valve. Thus, any abnormal increase of heat-exchanger pressure is detected by detecting the abnormal temperature increase of either the indoor or outdoor heat-exchanger and by controlling the opening of the flow-control valve.

A third exemplary embodiment of the present invention uses a non-azeotropic refrigerant prepared obtained by mixing R32, R125, and R134a refrigerants at a weight ratio of 23/25/52, and employs a refrigerating cycle obtained by connecting a fractionator instead of the reheater to the overhead condenser provided on the top of the fractionator, and at the same time, by providing a circuit that returns one of the two circuits separating the refrigerant liquified by the overhead condenser to the top of the fractionator, and another circuit connecting the liquified refrigerant to the flow-control valve. The third exemplary embodiment further employs an indoor-temperature detecting means for detecting the indoor-temperature instead of the outdoor and indoor heat-exchanger temperature detecting means, a third comparison means for comparing the value detected by the operation-mode detecting means with the value of preset operation mode, and an indoor temperature setting means for setting the indoor temperature at a desired value. The flow-control valve control means is comprised of a difference-temperature detecting mans for deriving a difference temperature between the indoor-temperature and the outdoor-temperature from the input signals to the indoor-temperature from the input signals to the indoor temperature detecting means and the indoor-temperature setting means, an indoor-load deriving means for deriving the indoor-load from the difference-temperature, and a fourth comparison means for comparing the value derived by the indoor-temperature deriving means with the predetermined indoor load value. The third exemplary embodiment further employs a memory means for memorizing the output modes controlling the opening of the flow-control valve, a selection means for selecting one of the output modes memorized in the memory means according to the signals outputted from the third and fourth comparing means, and an output means for outputting a signal to the selection means according to the signals outputted from the third and fourth comparison means and controlling the opening of the flow-control valve. Thus, an optimum refrigerating cycle is realized quickly in accordance with the required load while suppressing the large variations of refrigerant volume.

A fourth exemplary embodiment of the present invention provides an outdoor heat-exchanger temperature detecting means and an indoor heat-exchanger temperature detecting means to the outdoor heat-exchanger and indoor heat-exchanger described in the third exemplay embodiment. The flow-control valve control means is comprised of a first comparison means for comparing the outdoor heat-exchanger temperature detected by the outdoor heat-exchanger temperature detecting means with the preset outdoor heat-exchanger temperature and outputting a control signal, a second comparison means for comparing the indoor heat-exchanger temperature detected by the indoor heat-exchanger temperature detecting means with the preset indoor heat-exchanger temperature and outputting a control signal, and a third comparison means for comparing the value detected by the operation mode detecting means with the value of preset operation mode. The fourth exemplary embodiment further employs a difference-temperature detecting means for deriving a difference between the indoor-temperature and the preset indoor-temperature from the signals from the indoor-temperature detecting means and the indoor-temperature setting means, an indoor load deriving means for deriving the indoor load from the before-obtained difference temperature, a fourth comparison means for comparing the value derived by the indoor-load deriving means with the value of reset load and outputting a comparison signal, a memory means for memorizing the output modes controlling the opening of the flow control valve, a selection means for selecting one of the output modes memorized in the memory means from the output signals of the first to the fourth comparison means, and an output means for outputting a signal of the selection means according to the signals from the first to fourth comparison means and controlling the opening of the flow-control valve. Thus, an optimum refrigerating cycle with at least refrigerant volume variations matched to the required load securing safety is realized.

A fifth exemplary embodiment of the present invention provides a reheater on the bottom of the fractionator incorporated in the refrigerating cycle of the fourth exemplary embodiment through a second flow-control valve by which the refrigerant evaporated by the reheater is returned to the bottom of the fractionator. The flow-control valve control means is comprised of a first to fourth comparison means mentioned in the fourth exemplary embodiment, a memory means memorizing the output modes controlling the openings of the first and second flow control valves, a selecting means selecting one of the output modes memorized in the memory means by the signals outputted from the first to fourth comparison means, and an output means outputting a signal for the selection means according to the first to fourth comparison means and controlling the openings of the first and second flow control valves. Thus, an optimum refrigerating cycle is obtained quickly responding to the required load and securing a wide range of capacity control.

A sixth exemplary embodiment of the present invention is obtained by using a non-azeotropic refrigerant and by employing a refrigerating cycle obtained by connecting a variable volume compressor, condenser, fractionator, overhead condenser, first flow-control valve, first throttle device, and an evaporator in the form of a ring. The sixth exemplary embodiment further employs a separator for separating the refrigerant liquified in the overhead condenser into two circuits, one of which is used as a circuit for returning the separated refrigerant to the top of the fractionator, and the other is used as a circuit for connecting the separated refrigerant to the first flow control valve. A reheater is connected to the bottom of the fractionator in order to evaporate the refrigerant. The evaporated refrigerant is separated into two circuits, one of which is used as a circuit for returning to the bottom of the fractionator and the other is used as a circuit for connecting from the first flow-control valve to the first throttle device through a second flow-control valve. The sixth exemplary embodiment further employs an indoor-temperature detecting means for detecting the indoor-temperature, an indoor temperature setting means for setting the indoor-temperature at a desired temperature, and a flow-control valve controlling means. The flow-control valve controlling means is comprised of a difference temperature detecting means for detecting the difference between the indoor-temperature and the preset indoor-temperature from the input signals to the indoor temperature detecting means and the indoor temperature setting means, an indoor-load deriving means for deriving the indoor-load from the difference temperature, a fourth comparison means for outputting a comparison signal by comparing the value derived by the indoor load deriving means with the value of preset load, a memory means for memorizing the output modes controlling the openings of the first and second flow-control valves, a selection means for selecting one of the output modes memorized in the memory means according to the signal outputted from the fourth comparison means, and an output means for outputting a signal of the fourth comparison means controlling the openings of the first and second flow-control valves. Thus, an optimum refrigerating cycle responding quickly to the required load can be obtained.

A seventh exemplary embodiment of the present invention provides a condenser temperature detecting means for detecting the temperature of a condenser added to the refrigerating cycle of the sixth exemplary embodiment. The flow-control valve controlling means is comprised of a first comparison means for comparing the condenser temperature detected by the condenser temperature detecting means with the preset condenser temperature and outputting a control signal, a fourth comparison means according to the sixth exemplary embodiment, a memory means for memorizing the output modes controlling the openings of the first and second flow-control valves, a selection means for selecting one of the output mode memorized in the memory means by the signal outputted from the first and fourth comparison means, and an output means for controlling the openings of the first and second flow-control valves by the signal from the selection means according to the signals generated by the first and fourth comparison means. Thus, an optimum refrigerating cycle matched to the required load is realized while detecting and avoiding any abnormal increase of condenser pressure.

An eighth exemplary embodiment of the present invention is obtained by using a non-azeotropic refrigerant and employs a refrigerant cycle by connecting a variable volume compressor, four-way valve, out-door heat-exchanger, second throttle device, third flow-control valve, fractionator, overhead condenser provided on the top of the fractionator, first flow-control valve, fourth flow-control valve, first throttle device, and an indoor heat-exchanger in the form of a ring. Two circuits are employed in which the refrigerant liquified by the overhead condenser is supplied, one of which is used as a circuit for returning the liquified refrigerant to the top of the fractionator, and the other is used as a circuit connected to the first flow-control valve. The eighth exemplary embodiment further employs two circuits in which the refrigerant evaporated by the reheater is supplied, one of which is used as a circuit for returning the evaporated refrigerant to the bottom of the fractionator and the other circuit is used as a circuit for connecting the first flow-control valve to the fourth flow-control valve through the second flow-control valve. The circuit connecting the second throttle device to the third flow-control valve is connected to a circuit for connecting the first flow control valve to the fourth flow control valve through the fifth flow-control valve, and the circuit connects the third flow-control valve to the fractionator, and the circuit connects the fourth flow-control valve to the first throttle device through the sixth flow-control valve. The eighth exemplary embodiment further employs an indoor-temperature detecting means for detecting the indoor temperature, an indoor temperature setting means for setting the indoor temperature at a desired temperature, an operating mode detection means for detecting the currently employed operating mode, and a flow-control valve controlling means. The flow control valve controlling means is provided with a third comparison means for comparing the value detected by the operating mode detecting means with the preset operating mode value, a difference temperature deriving means for deriving the difference between the indoor-temperature and the preset indoor-temperature from the signals obtained from the indoor-temperature detecting means and the indoor-temperature setting means, an indoor-load deriving means for deriving the indoor-load from the difference temperature, a fourth comparison means for comparing the value derived by the indoor-load deriving means with the preset load and outputting a difference signal, a memory means for memorizing the output modes controlling the openings of all of the first to sixth flow-control valves, and a selecting means for selecting one of the output modes memorized in the memory means by the output signal outputted from the fourth comparison means. Thus, an output signal is obtained from the selecting means according to the signals from the third and fourth comparison means, thereby controlling the openings of the first to the sixth flow control valves. Thus, an optimum refrigerating cycle operable in wider operation range is realized.

A ninth exemplary embodiment of the present invention is obtained by providing outdoor and indoor heat-exchanger temperature detecting means to the outdoor and indoor heat-exchanger mentioned in the eighth exemplary embodiment. The flow-control valve controlling means is comprised of a first comparison means for comparing the outdoor heat-exchanger temperature detected by the outdoor heat-exchanger temperature detecting means with the preset outdoor heat-exchanger temperature outputting a control signal, a second comparison means for comparing the indoor heat exchanger temperature detected by the indoor heat-exchanger temperature detecting means with the preset indoor heat-exchanger temperature outputting a control signal, a third and fourth comparison means described in the eighth exemplary embodiment, a selection means for selecting one of the output modes memorized in the memory means by signals outputted from the first to fourth selection means, and an output means for outputting signals from the selection means according to the signals from the first to fourth comparison means, thereby controlling the openings of the first to sixth flow-control valves. Thus, an optimum refrigerating cycle matched to the required load securing the safety in the wider operating range can be realized.

A tenth exemplary embodiment of the present invention employs a mixed non-azeotropic refrigerant comprised of more than two kinds of refrigerants selected out of R32, R125, and R134a refrigerants as the refrigerant to be used in either the sixth, seventh, eighth or ninth exemplary embodiment. Thus, a refrigeration cycle securing a refrigerating capability equivalent to that attainable by using the R22 refrigerant is realized.

An eleventh exemplary embodiment employs a mixed non-azeotropic refrigerant available by mixing R32, R125, and R134a refrigerants at a weight ratio of 23/25/52 as the refrigerant to be used in either of the sixth, seventh, eighth, or ninth exemplary embodiment. Thus, a refrigerating cycle securing a refrigerating capability and a temperature pressure characteristics attainable by using the R22 refrigerant is obtained.

A twelfth exemplary embodiment of the present invention employs a mixed non-azeotropic refrigerant available by mixing R32, R125, and R134a refrigerants at a weight ratio of 45/45/10 as the refrigerant to be used in either of the sixth, seventh, eighth, or ninth exemplary embodiment. Thus, a refrigerating cycle securing a higher COP attainable by using the R22 refrigerant is obtained.

DETAILED DESCRIPTION OF THE INVENTION

Some of the exemplary embodiments of the invention are now explained with reference to FIGS. 1 to 36.

Embodiment-1

Figure 1:
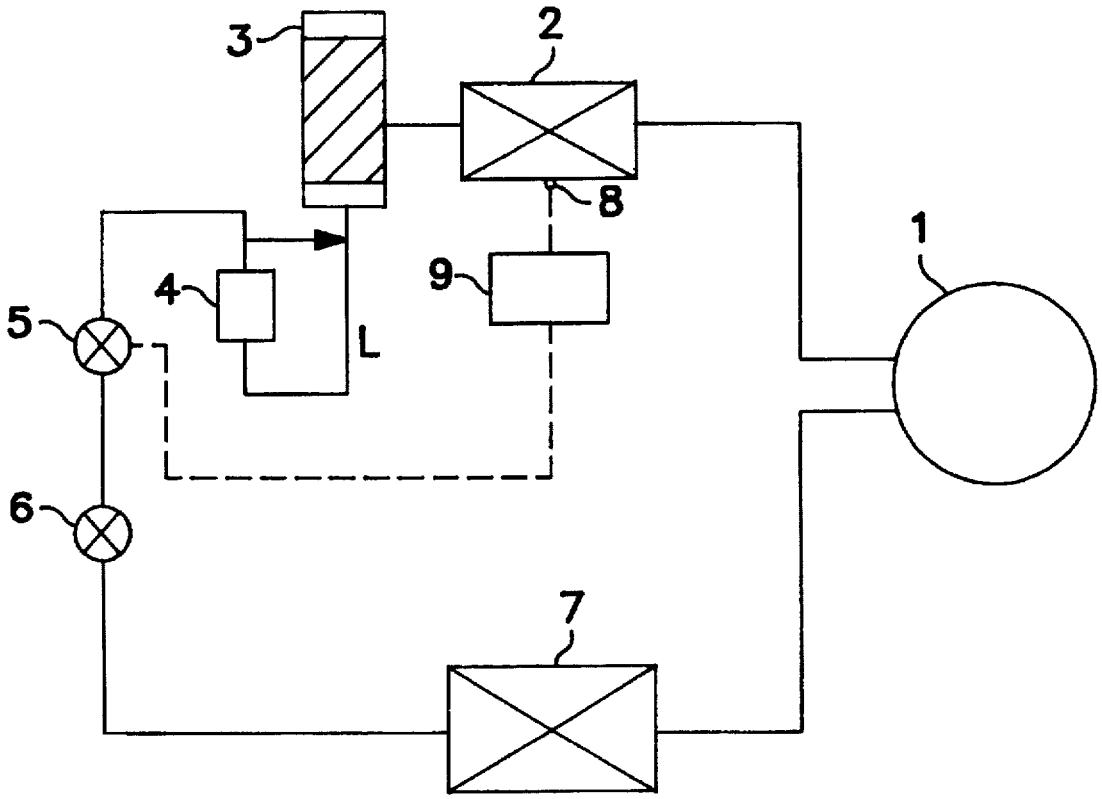
FIG. 1 shows a diagram of a refrigerating cycle of the refrigerator provided with a controller in accordance with a first exemplary embodiment of the present invention.

FIG. 1 shows a diagram of refrigerating cycle realized in the controller of Embodiment-1. FIG. 1 shows a variable-volume type compressor consisting of compressor 1, condenser 2, fractionator 3, reheater 4 provided on the bottom of fractionator 3, flow-control valve 5, throttle device 6, and evaporator 7, all of which are connected in a form of a ring, to implement a refrigerating cycle by using a non-azeotropic refrigerant. The refrigerant evaporated by reheater 4 is divided into two circuits, one of which is used as a circuit for returning the evaporated refrigerant to the bottom of fractionator 3 and the other is connected to flow-control valve 5. In addition, a controller is constructed by providing a condenser-temperature detector (condenser temperature by detecting means) 8 on condenser 2 and a flow-controller (flow-control valve controlling means) controlling the flow-control valve 5.

The operation of thus constructed refrigerator is now explained below. At first, the vapor of refrigerant compressed by compressor 1 is turned into a partially condensed liquid by means of condenser 2 and is introduced into fractionator 3 where the bottom-liquid L having a high composition ratio of a high boiling point component is separated. Bottom-liquid L collected on the bottom of reheater 4 is then heated and is turned into saturated vapor, and a part of it is introduced into evaporator 7 after losing its pressure by throttle-device 6 and the other part is recirculated to the bottom of fractionator 3 and is used as a heat source of fractionator 3.

The composition of bottom-liquid L is nearly the same as that of condensed liquid obtained at the outlet of condenser 2 if the circulated volume of bottom liquid L to fractionator 3 is very little, so that the refrigerant holding the same composition is evaporated generating low temperature, and is returned to compressor 1. When the volume of bottom-liquid L circulated to the bottom of fractionator 3 is increased, the circulated vapor rises upward within fractionator 3, contacts the surface of filler provided in fractionator 3, and is fractionated, thereby increasing the composition of the high boiling point component so that a refrigerant having a higher composition of the high boiling point component can be fed to the refrigerator.

Figure 2:
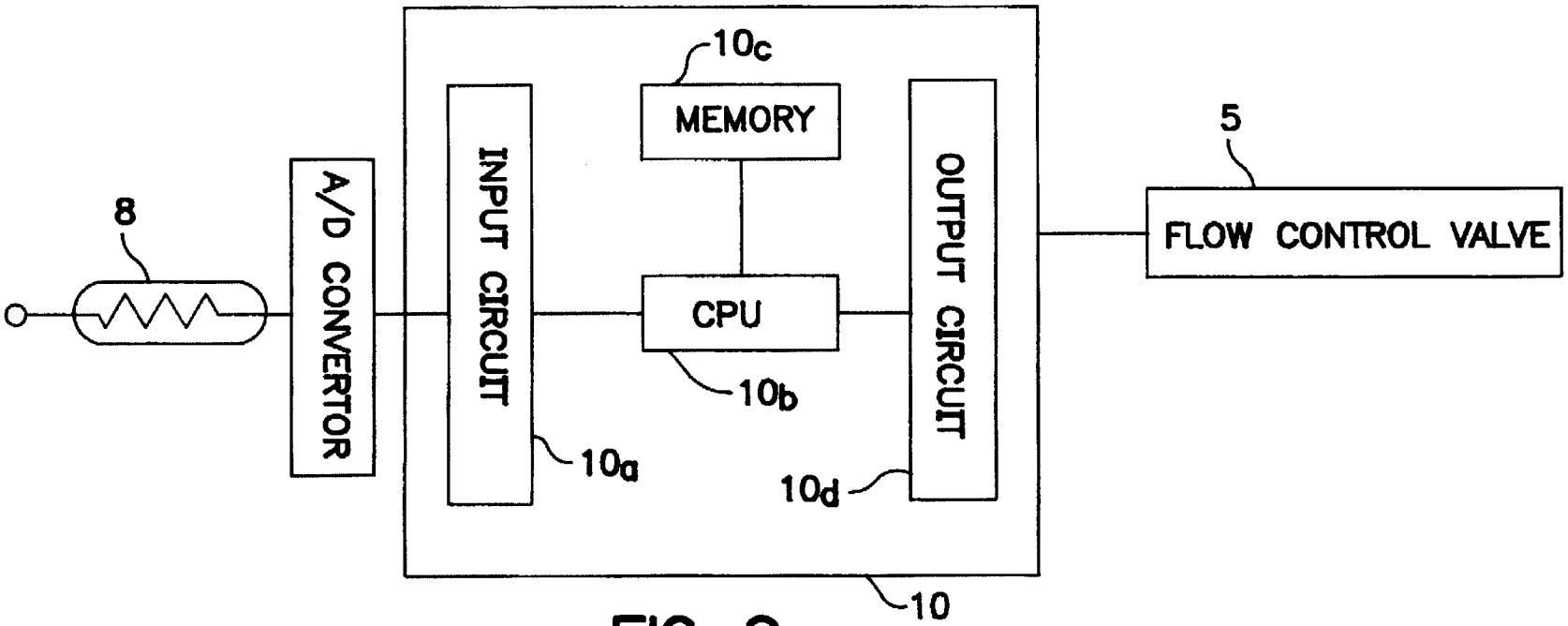
FIG. 2 shows a block diagram of a control circuit employed in the controller in accordance with the first exemplary embodiment of the present invention.

A block diagram of a control-circuit employed in the controller is shown in FIG. 2 wherein 10 is a micro-computer (hereinafter, this is abbreviated as LSI) comprising flow-controller 9 (shown in FIG. 1) together with input circuit 10*a*, CPU 10*b*, memory 10*c* and output circuit 10*d*. The output of condenser-temperature detector 8 is inputted to input-circuit 10*a* through an A/D converter, and the opening of flow control valve 5 is controlled by the signal outputted from output-circuit 10*d*.

Figure 3:
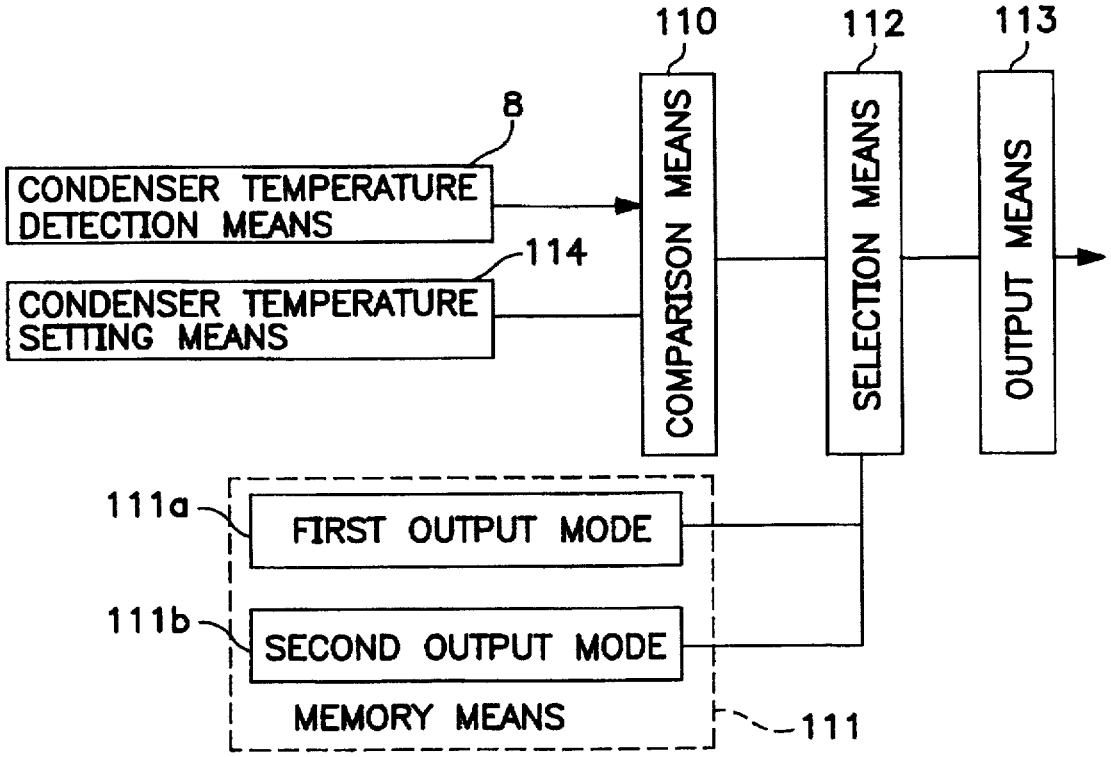
FIG. 3 shows a block diagram of the controller in accordance with the first exemplary embodiment of the present invention.

The block diagram of the controller shown in FIG. 3, is now explained by referring to FIG. 2. LSI 10 corresponds to a comparison means 110 for comparing the temperature outputted from condenser temperature detector 8 with the preset condenser temperature memorized in memory 10*c* and outputting a control signal, a memory means 111 with first output mode 111*a* and second output mode 111*b* for memorizing the output modes controlling flow-control valve 5, and a selecting means 112 for selecting one of the output modes memorized in the memory means by the output signal generated by the comparison means, constructing a flow-controller (flow-control valve controlling means) obtained by combining a signal outputted from the selecting means and an output-means 113 for controlling the opening of flow-control valve 5. OPEN is indicated when flow-control valve 5 is [ON] while HALF-OPEN is indicated when it is set to [OFF]. Condenser temperature setting means is indicated by reference numeral 114.

Figure 4:
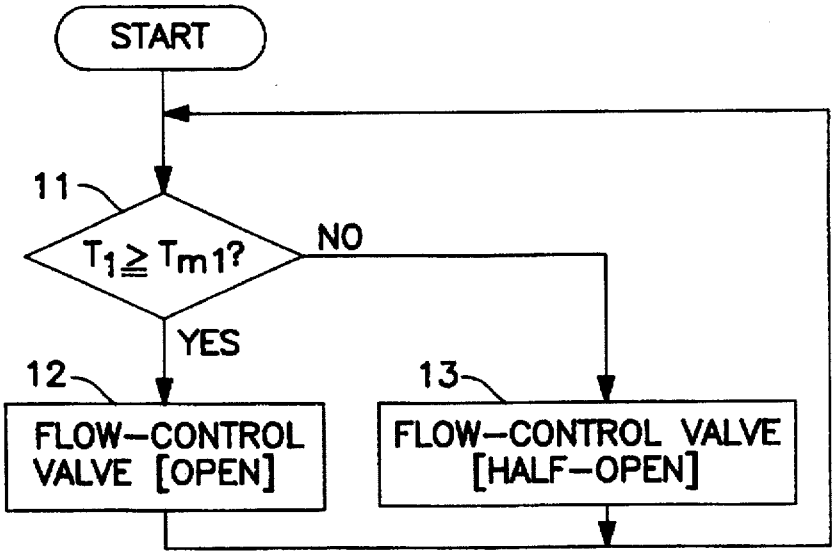
FIG. 4 shows a flow-chart explaining the operation of the controller in accordance with the first exemplary embodiment of the present invention.

FIG. 4 is a flow-chart showing the refrigerator program memorized in memory 10*c* of LSI 10. The Flow-control valve 5 is so controlled that it is set at a condition of [ON] only when an abnormal pressure increase of condenser 2 is possible. When the operation is commanded to start by either a remote-control signal or a forced-operation signal, the operation of the refrigerator begins, and at the same time, the process shown in Step-11, as is shown in FIG. 4, are started.

When a relation of $T_1>T_{M1}$ is obtained as a result of a comparison operation which compares the temperature $T_{M1}$ detected by condenser-temperature detector 8 with the preset temperature $T_{M1}$ (e.g. 65° C.), [YES] is judged and processing proceeds to Step-12. In Step-12, a first output mode memorized in the memory circuit (memory means) is selected by the selection means incorporated in memory 10*c*, flow-control valve 5 is set to [ON] by a control signal outputted from output-circuit (output means) 10*d*, and processing returns to Step-11.

If $T_1<T_{M1}$, [NO] is judged and processing proceeds to Step-13. In Step-13, by a selection means incorporated in memory 10*c*, a second output mode memorized in the memory means is selected and a control-signal is outputted from the output means (output-circuit 10*d*) turning flow-control valve 5 to [OFF] and proceesing returns to Step-11.

Each of these steps is now explained below. Step-11 is a comparison operation for determining if the pressure of condenser 2 is higher than the set pressure or not by detecting the condenser temperature. In Step-12, a control signal turning flow-control valve 5 to [ON] is outputted.

Thus, a refrigerant containing the high boiling-point component at high ratio is introduced in the condenser, decreasing the condenser-pressure to a pressure less than the preset pressure. In Step-13, flow-control valve 5 is turned to [ON], thereby bringing the device into a condition of normal operation.

As above-explained, the abnormal increase of condenser pressure is detectable and avoidable by controlling flow-control valve 5 in accordance with the output of condenser-temperature detector 8, so that a continuously operable refrigeration cycle can be realized.

Embodiment-2

FIGS. 5 to 8 respectively show a diagram of a refrigerating cycle, a block diagram of a control circuit, a block diagram of a controller, and a flow-chart of the program of the controller realized in the refrigerator Embodiment-2. The differences of Embodiment-2 from Embodiment-1 are the provisions of four-way valve 14, outdoor heat-exchanger 15 instead of the condenser, indoor heat-exchanger 16 instead of the evaporator, outdoor heat-exchanger temperature detector (outdoor heat-exchanger temperature detection means) 17, indoor heat-exchanger temperature detector (indoor heat-exchanger temperature detection means) 18, and operation mode detector (operation mode detection means) 19.

Those devices that are the same as those shown in Embodiment-1 are identified by the same numbers, and the explanation of those is omitted.

Figure 5:
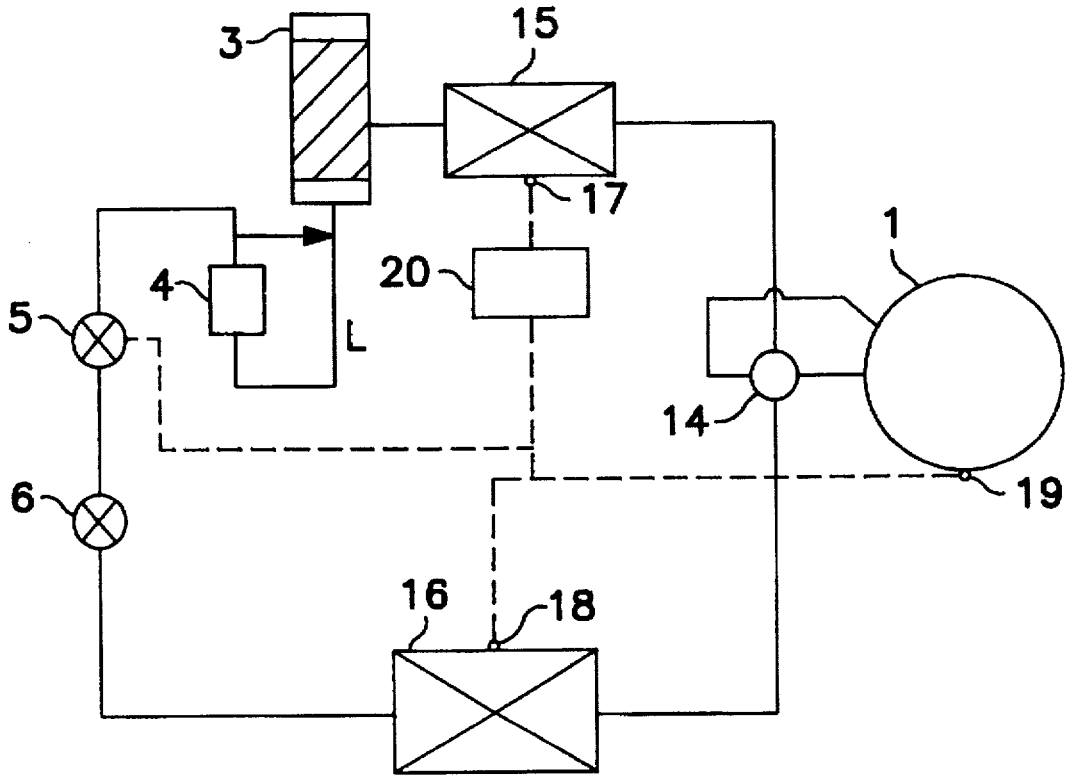
FIG. 5 shows a refrigerating cycle diagram of a refrigerator controlled by a controller in accordance with a second exemplary embodiment of the present invention.
Figure 6:
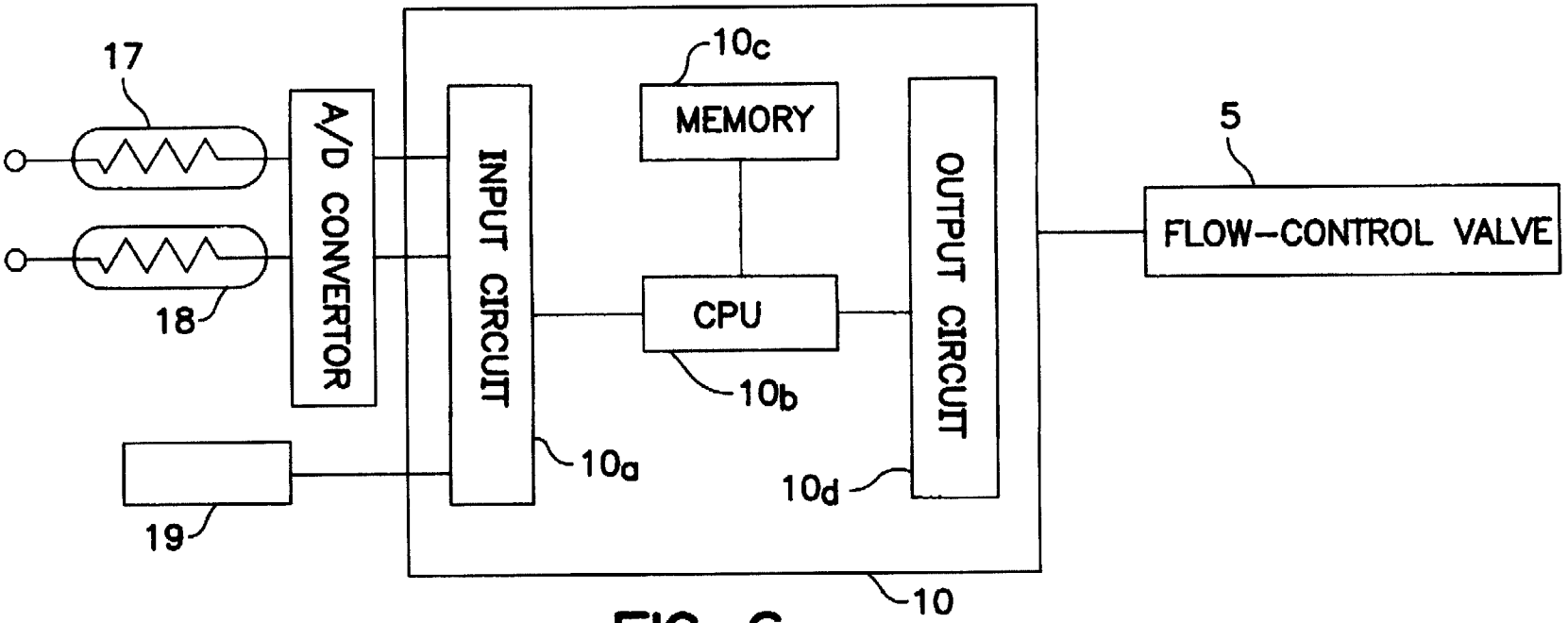
FIG. 6 shows a block diagram of a control circuit provided within the controller in accordance with the second exemplary embodiment of the present invention.
Figure 7:
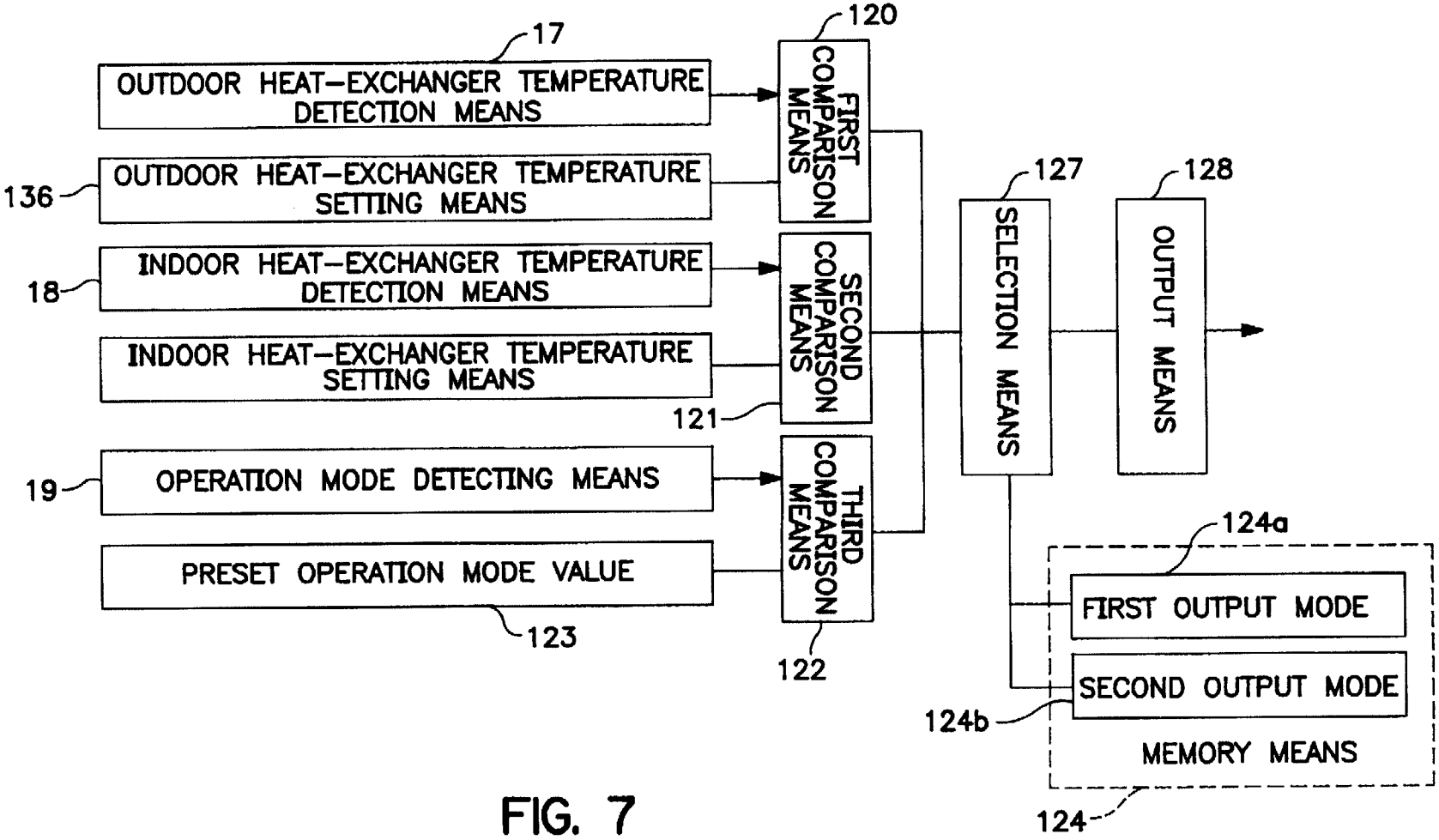
FIG. 7 shows a block diagram of the controller in accordance with the second exemplary embodiment of the present invention.

As shown in FIGS. 5 to 7, flow-controller 20 is comprised of a first comparison means 120 for comparing the outdoor heat-exchanger temperature obtained by outdoor heat-exchanger temperature detector 17 with the preset outdoor heat-exchanger temperature and outputting an output-signal, a second comparison means 121 for comparing the indoor heat-exchanger temperature obtained by indoor heat-exchanger temperature detector 18 with the preset indoor heat-exchanger temperature and outputting an output signal, a third comparison means 122 for comparing the value detected by the operation mode detector 19 with the preset operation mode 123, a memory means 124 with first output mode 124*a* and second output mode 124*b* for memorizing the output modes controlling the opening of flow control valve 5, a selection means 127 for selecting one of the operation modes memorized in the memory means in accordance with the output signals of the first to third comparison means, and an output means 128 for outputting a signal to the selection means according to the output signals of the first to third comparison means controlling the opening of flow control valve 5. Outdoor heat-exchanger is indicated by reference numeral 136.

Figure 8:
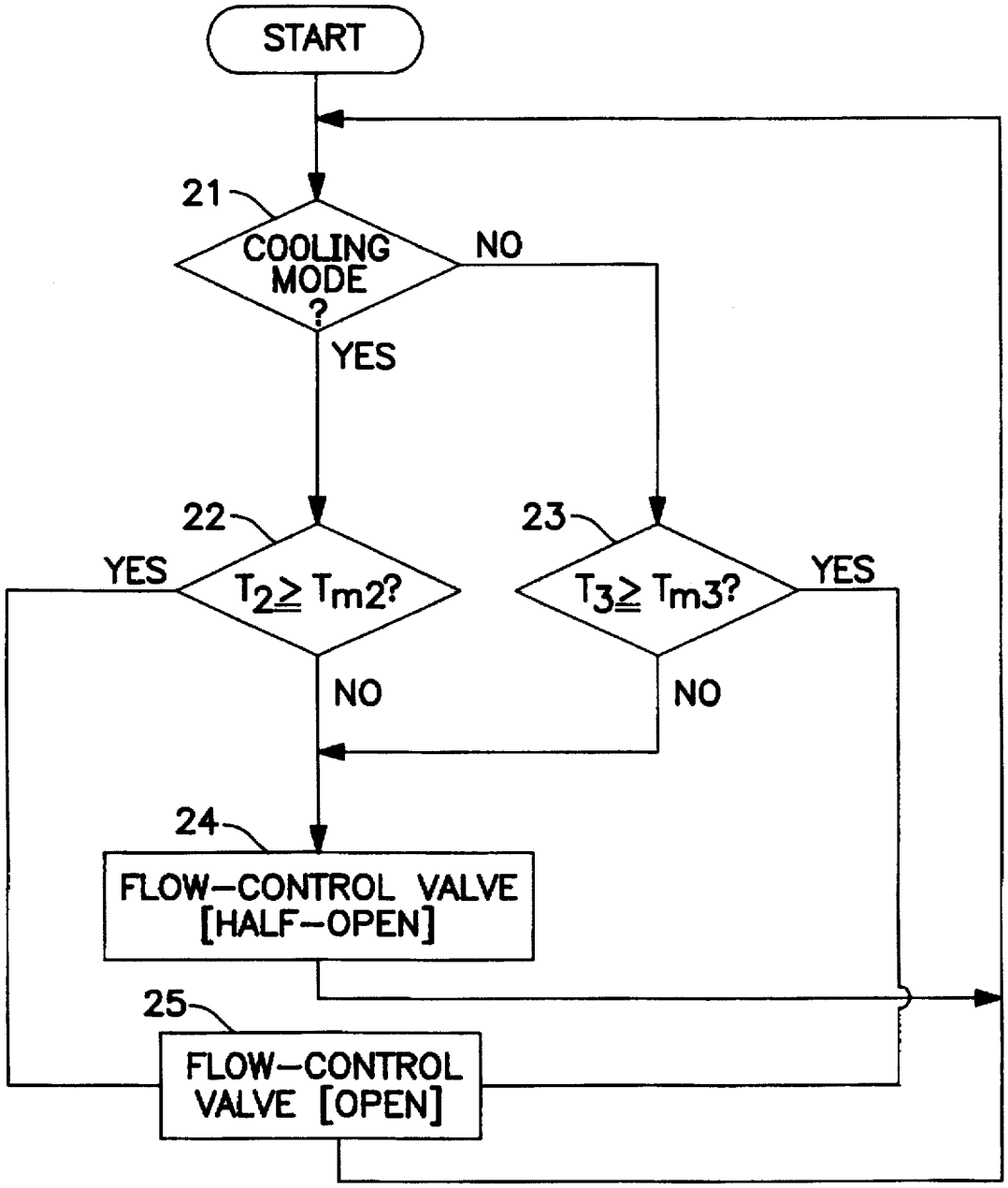
FIG. 8 shows a flow-chart explaining the operation of the controller in accordance with the second exemplary embodiment of the present invention.

The operation of thus constituted controller is now explained by referring to FIG. 8. As seen from this flow-chart, flow-control valve 5 is controlled so that it is set to [ON] only when a possibility of excessive increase of the pressure of outdoor heat exchanger 15 at cooling or indoor heat exchanger 16 at heating exists. That is, when the operation of the refrigerator is started upon receiving a remote control command or a forced operation command, the execution of Step-21 shown in FIG. 8 is also started simultaneously.

At this time, [YES] is judged when the signal outputted from operation-mode detector 19 shows [cooling], and the processing continues at Step-22. If [NO] is judged at [heating], processing continues at Step-23. In Step-22, if $T_2 \geqq T_{M2}$ is derived from the result of a comparison operation comparing the temperature $T_2$ detected by outdoor heat exchanger temperature detector 17 with the preset temperature $T_{M2}$ (e.g. 65° C.), [YES] is judged, and processing continues at Step-25.

In Step-25, the first output mode memorized in the memory means is selected by the selection means memorized in memory 10 and a control-signal is outputted from output-circuit 10*d* so that flow-control valve 5 is set to [ON] and processing returns to Step-21. If $T_2 < T_{M2}$, [NO] is judged and processing continues at Step-24. In Step-24, the second output mode memorized in the memory means is selected by the selection means with built-in memory 10, a control signal is outputted from output circuit 10*d* and processing returns to Step-21 after setting flow control valve 5 to [OFF].

In Step-23, if $T_3 \geqq T_{M3}$ is obtained from the result of a comparison operation comparing the temperature $T_3$ detected by indoor heat-exchanger temperature detector 18 with the preset temperature $T_{M3}$ (e.g. 65° C.), [YES] is judged and processing continues at Step-25. If $T_3 < T_{M3}$, [NO] is judged and processing continues at Step-24. Each of these steps is explained below.

In Step-21, judgment is made to identify the operation mode if it is cooling or heating, and in Step-22, a comparison operation determines if the pressure of outdoor heat exchanger 15 is higher than the preset pressure or not determined from the preset temperature of outdoor heat-exchanger. In Step-24, a control signal is outputted in order to decrease the condenser pressure to a preset pressure by turning flow-control valve 5 to [ON]. Step-23 performs a comparison operation judging if the pressure of indoor heat exchanger 16 is higher than the preset pressure or not from the preset temperature of indoor heat-exchanger, and Step-24 resumes the normal refrigerator operation by turning flow control valve 5 to [OFF].

As to the above, by providing a temperature detection means to each of the outdoor heat-exchanger 15 and indoor heat-exchanger 16 and by controlling flow-control valve 5, a continuously operable cooling or heating cycle can be realized by detecting and avoiding any abnormal pressure increases.

Embodiment-3

FIGS. 9 to 12 show respectively a diagram of refrigerating cycle, a block diagram of a control circuit, a block diagram of a controller, and a flow chart of the program of the controller realized in the refrigerator of Embodiment-3.

The difference of Embodiment-3 from the previously described Embodiment-2 is the exclusion of the reheater and the indoor and outdoor heat-exchanger temperature detectors. On the other hand, a overhead condenser 26 is provided on top of the fractionator, and two circuits in which the refrigerant liquified by overhead condenser 26 is introduced, one of which acts as a return circuit to the top of fractionator 3 and the other connected to flow control valve 5, are provided together with the provisions of indoor temperature-detector (indoor temperature detecting means) 27 and indoor temperature-setter (indoor temperature setting means) 28. In addition to these, the same components as those shown in Embodiment-2 are identified by the same notations and the explanations are omitted.

Figure 9:
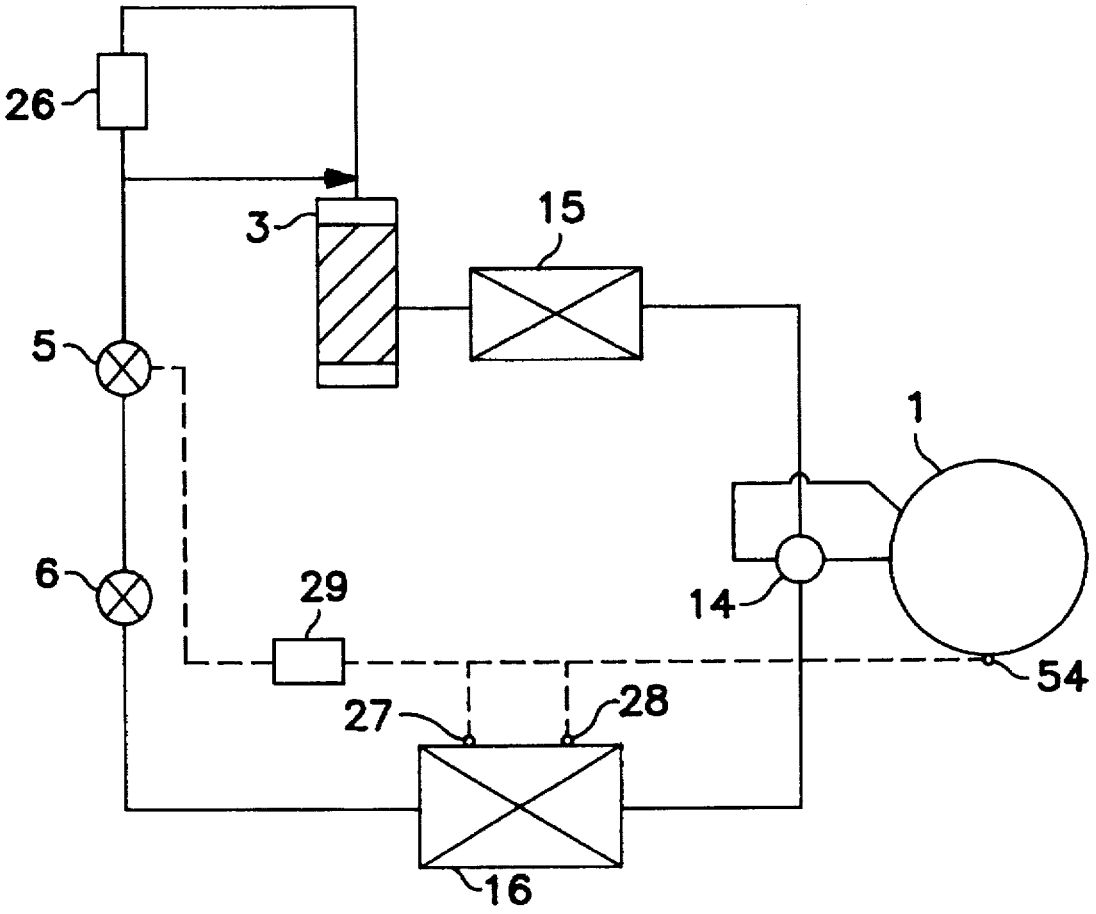
FIG. 9 shows a refrigerating cycle diagram obtained by a refrigerator controlled by a controller in accordance with a third exemplary embodiment of the present invention.
Figure 10:
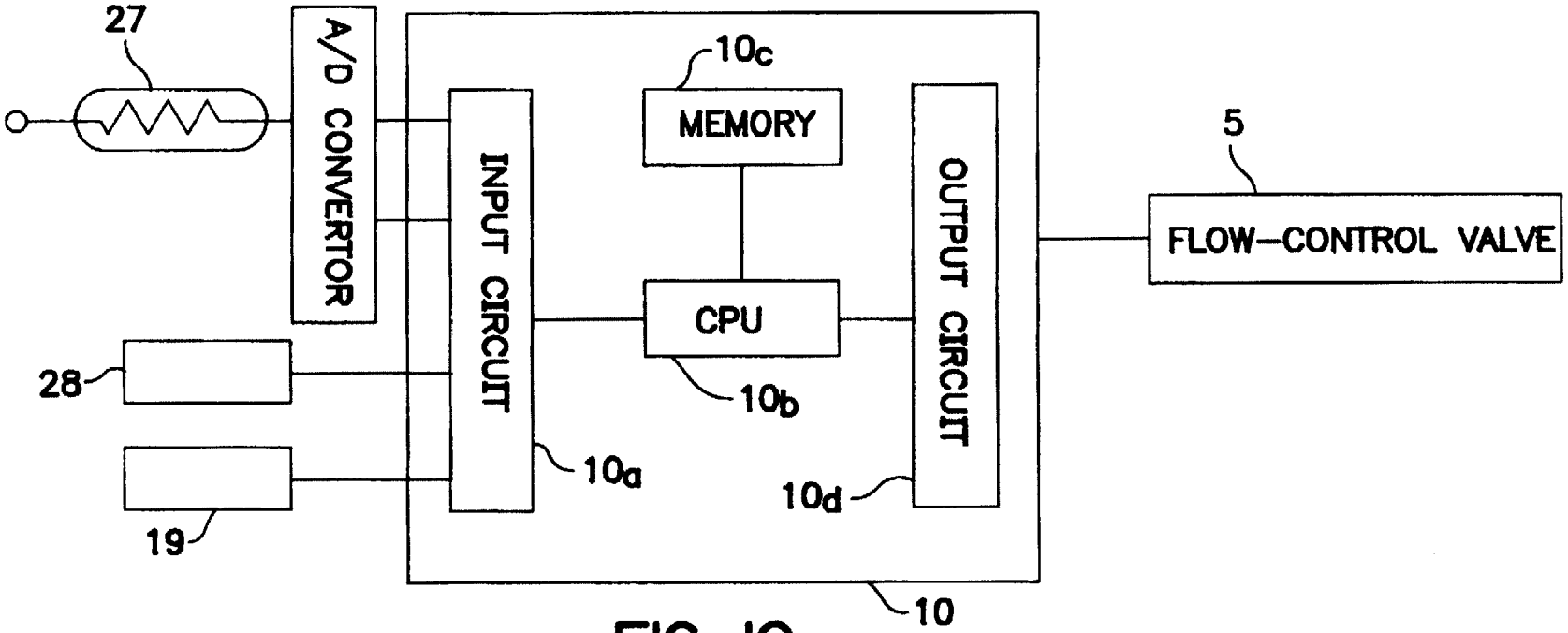
FIG. 10 shows a block diagram of control circuit of the controller in accordance with the third exemplary embodiment of the present invention.
Figure 11:
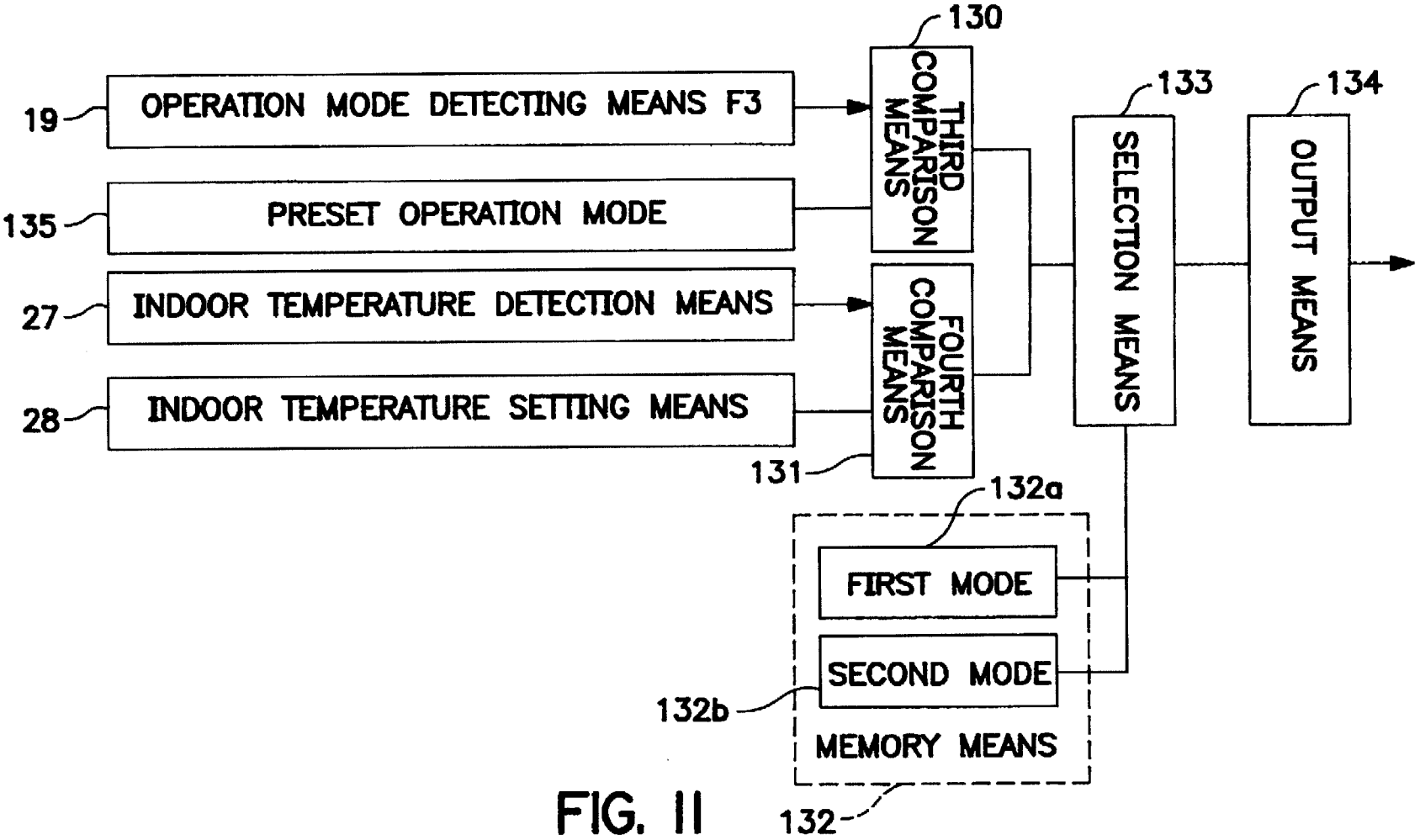
FIG. 11 shows a block diagram of the controller in accordance with the third exemplary embodiment of the present invention.

As shown in FIGS. 9 to 11, flow controller (flow control valve controlling means) 29 is comprised of a third comparison means 130, as in the case of Embodiment-2, a difference temperature detection means for determining the difference temperature between the indoor temperature and the preset indoor temperature from the input signals to indoor temperature detection means 27 and indoor temperature setting means 28, an indoor load deriving means for deriving the indoor load from the difference temperature, a first comparison means for comparing the difference between the value derived by the indoor load deriving means and the preset load value and outputting a comparison signal, a second comparison means for comparing the difference between the value detected by the operation mode detection means 19 and the predetermined operation mode value, a memory means 132 with first mode 132*a* and second mode 132*b* for memorizing the output modes controlling the opening of flow-control valve 5, a selection means 133 for selecting one of the operation modes memorized in the memory means by the signals outputted from the third and fourth comparison means, and an output means 134 for outputting a signal to the selection means according to the signals derived from the first and second comparison means and controlling the opening of flow control valve 5.

Figure 12:
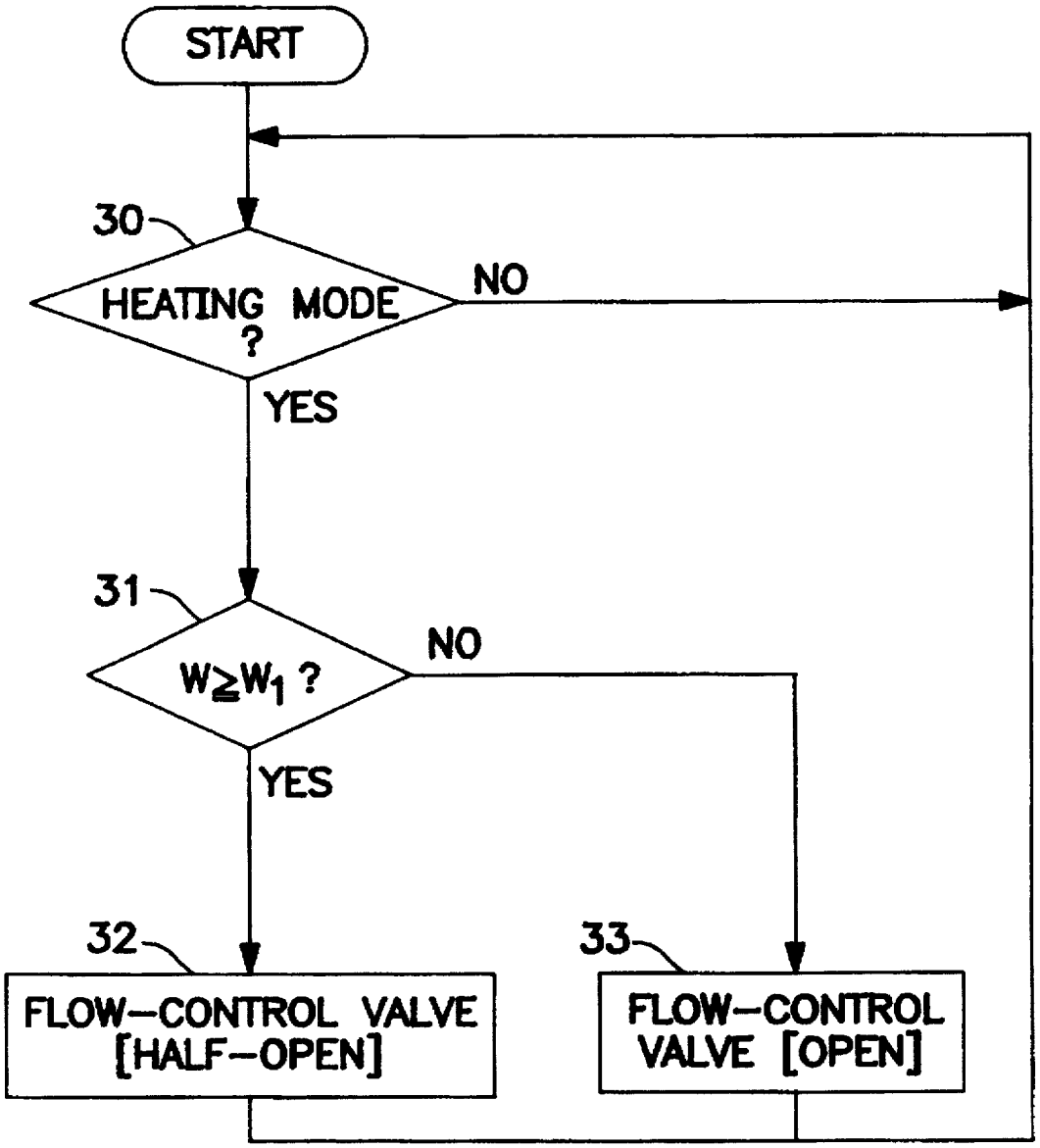
FIG. 12 shows a flow-chart explaining the operation of the controller in accordance with the third exemplary embodiment of the present invention.

The operation of thus constructed controller is explained by referring to FIG. 12. As seen from this flow-chart of the present invention, flow-control valve 5 is controlled so that it is set to [OFF] only when a possibility of indoor load value exceeding the preset value in the heating mode exists. That is, upon receiving an operation command by either remote control, forced operation, or other means, the operation of the refrigerator is started. At the same time, Step-30 shown in FIG. 12 is executed, and if the signal outputted from operation-mode detector 19 is [heating], [YES] is judged and processing continues at Step-31.

If [cooling] is shown, [NO] is judged and processing returns to Step-30. In Step-31, indoor-load W is derived from an operation determining the difference between the temperature $T_4$ determined by indoor-temperature setting device 28 (or the temperature preset by remote-controller) and the temperature $T_5$ detected by indoor-temperature detector 27. [YES] is judged if the difference operation determining the difference between the indoor-load W and the preset load $W_1$ (e.g. 4000 W) shows a relation of $W \geqq W_1$, and processing continues at Step-32.

In Step-32, the first output-mode memorized in the memory means is selected by the selection means incorporated in memory 10*c*, and a control signal is outputted from the output means (output circuit 10*d*) setting the flow control valve to [OFF], returning processing to Step-30. If $W<W_1$ is obtained, a judgment of [NO] is made, and processing continues at Step-33. In Step-33, the second output-mode memorized in the memory means is selected by the selection means incorporated in memory 10*c*, and a control-signal is outputted from output-circuit 10*d* setting flow-control valve 45 to [NO], and proessing returns to Step-30.

The above-described steps are now explained. Step-30 is a judgment operation for determining if the operation-mode is cooling or heating, Step-31 is a comparison operation for determining if the indoor-load is greater than a preset value or not from the preset indoor-temperature. In Step-32, an control signal turning flow-control valve 5 to [OFF] is outputted in order to increase the refrigerating capability by introducing a refrigerant having a high composition ratio of the low boiling-point component. In Step-33, flow-control valve 5 is turned to [ON] to bring the device into normal operation.

As explained above, an optimum refrigeration-cycle matched to the required load can be obtained within a short response time, by controlling flow-control valve 5 using indoor temperature setting device 28 and indoor-temperature detector 27.

Embodiment-4

FIGS. 13 to 16 show respectively a diagram of a refrigerating cycle, a block diagram of a control circuit, a block diagram of a controller, and a flow-chart showing the program of the controller, all of which are realized in the refrigerator of Embodiment-4.

The difference of Embodiment-4 from the previously described Embodiment-3 is the provision of indoor heat-exchanger temperature detector 17 and outdoor heat-exchanger temperature detector 18. The same devices as those shown in Embodiment-3 are identified by the same numbers and the explanation of those is omitted. Preset outdoor heat exchanger temperature is represented by reference numeral 140, preset indoor heat exchanger temperature is represented by reference numeral 141, and preset operation mode is represented by reference numeral 142.

Figure 13:
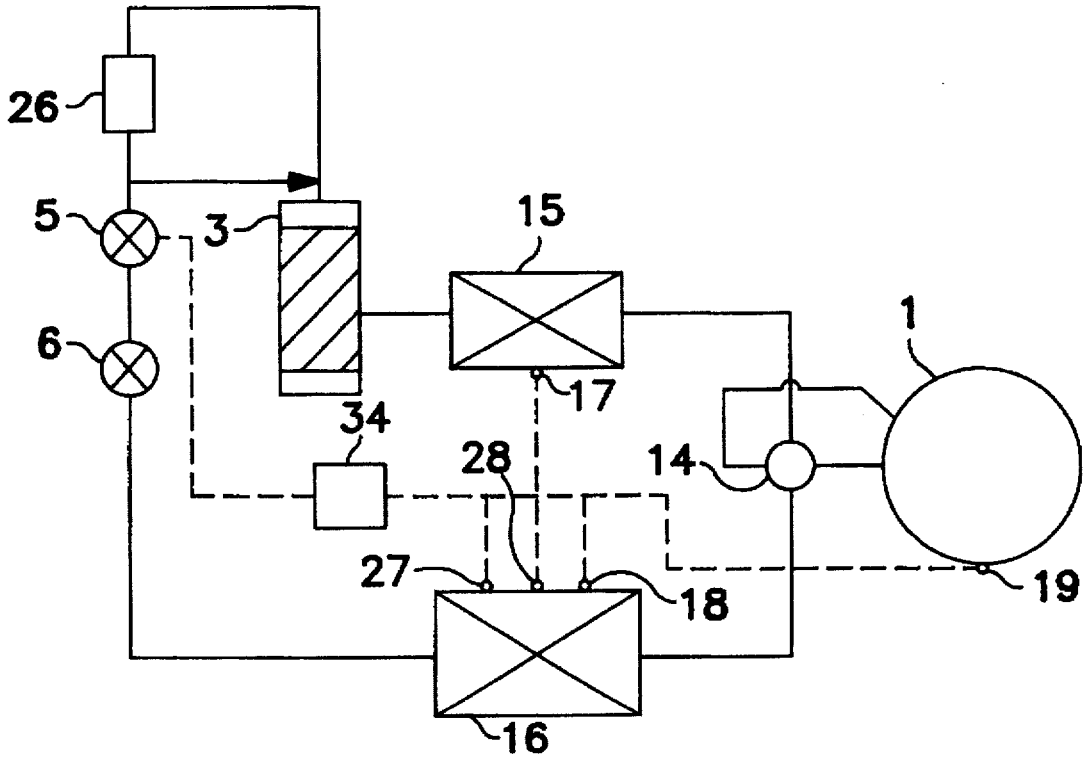
FIG. 13 shows a refrigerating cycle diagram of the refrigerator controlled by a controller in accordance with a fourth exemplary embodiment of the present invention.
Figure 14:
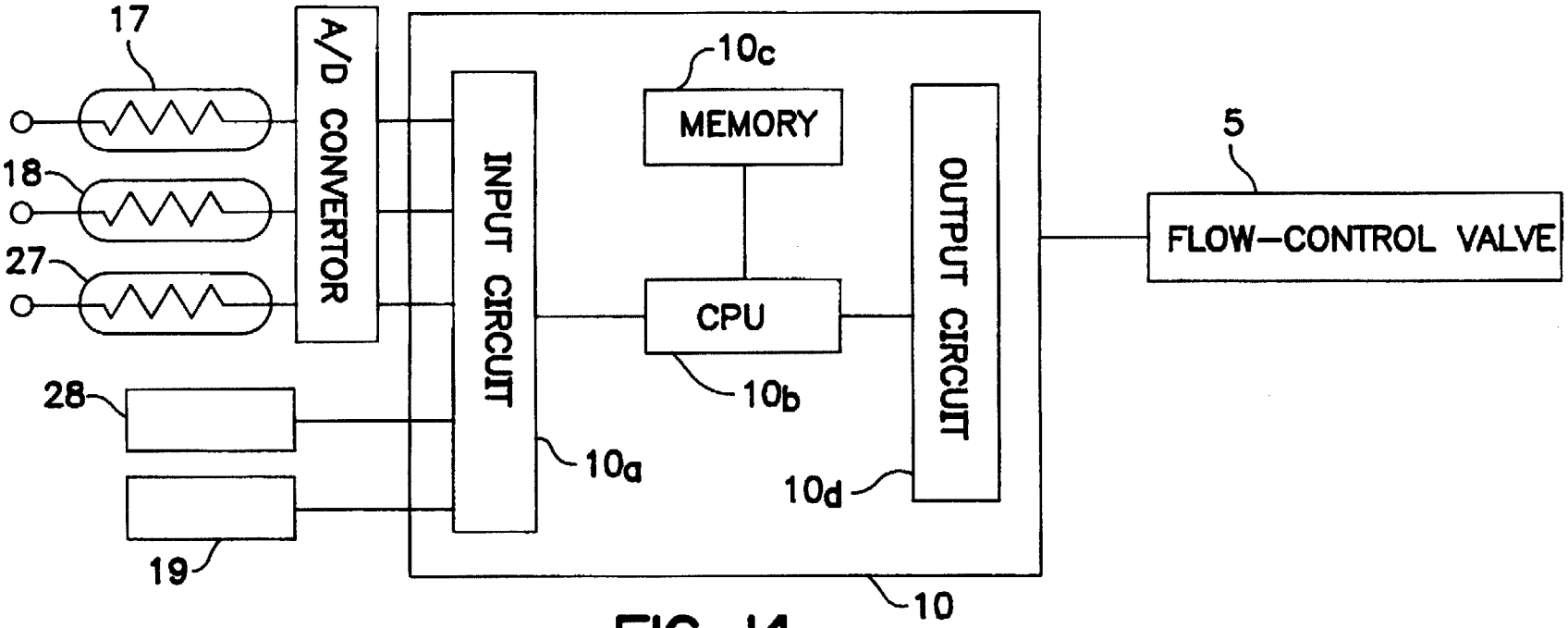
FIG. 14 shows a block diagram of a control circuit controlled by the controller in accordance with the fourth exemplary embodiment of the present invention.
Figure 15:
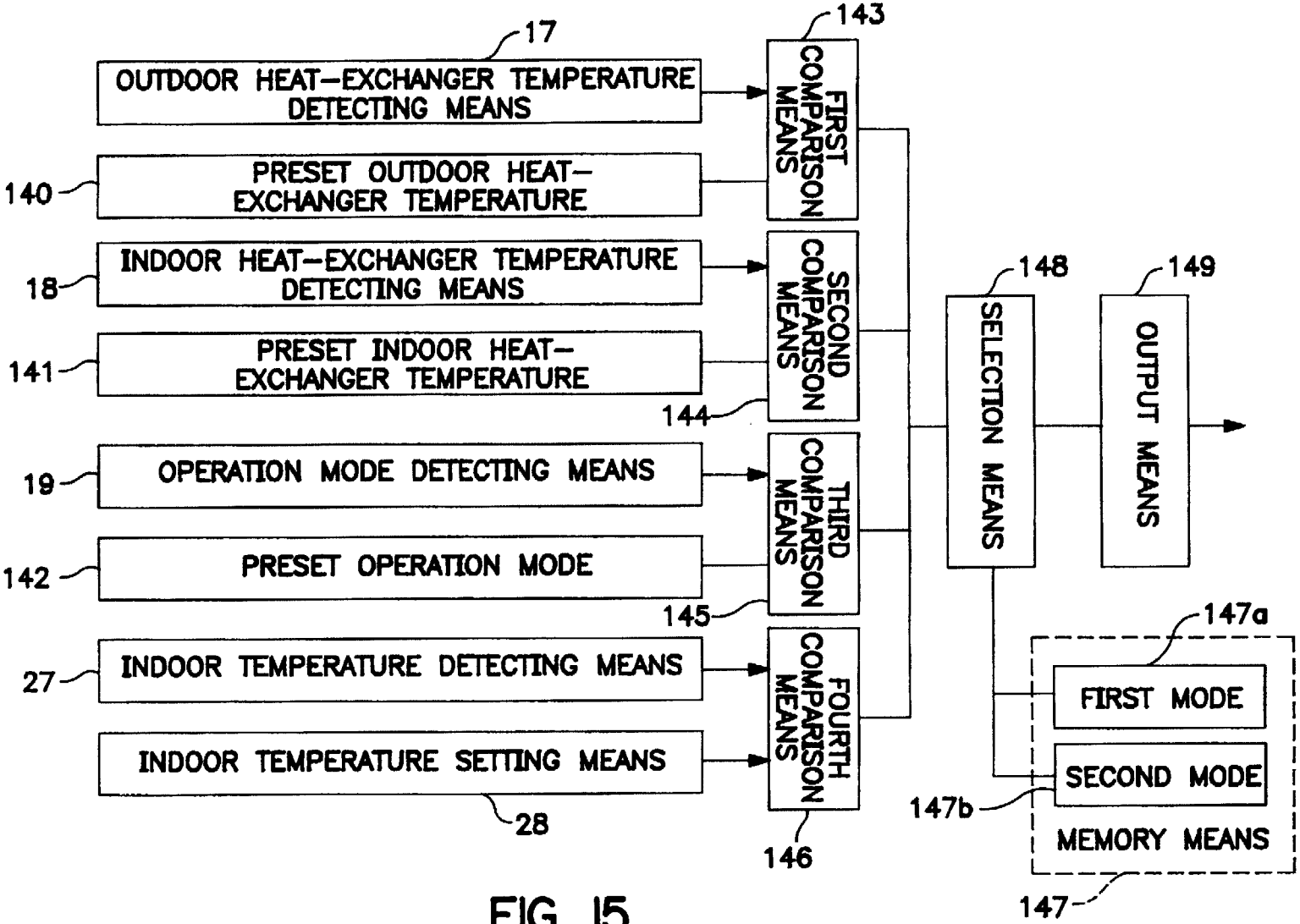
FIG. 15 shows a block diagram of the controller in accordance with the fourth exemplary embodiment of the present invention.

As shown in FIGS. 13 to 15, flow-controller 34 is comprised of a first comparison means 143 which is the same as the one shown in Embodiment-2, a second comparison means 144 which is the same as the one shown in Embodiment-2, a third comparison means 145 which is the same as the one shown in Embodiment-2, a fourth comparison means 146 which is the same as the one of Embodiment-2, a memory means 147 with a first mode 147*a* and a second mode 147*b* for memorizing the output-modes controlling the opening of flow-control valve 5, a selection means 148 for selecting one of the output modes memorized in the memory means according to the output-signal generated from the first to fourth comparison means, and output means 149 for outputting a signal to the selection means according to the signals from the first and second comparison means and controlling the opening of flow control valve 5.

Figure 16:
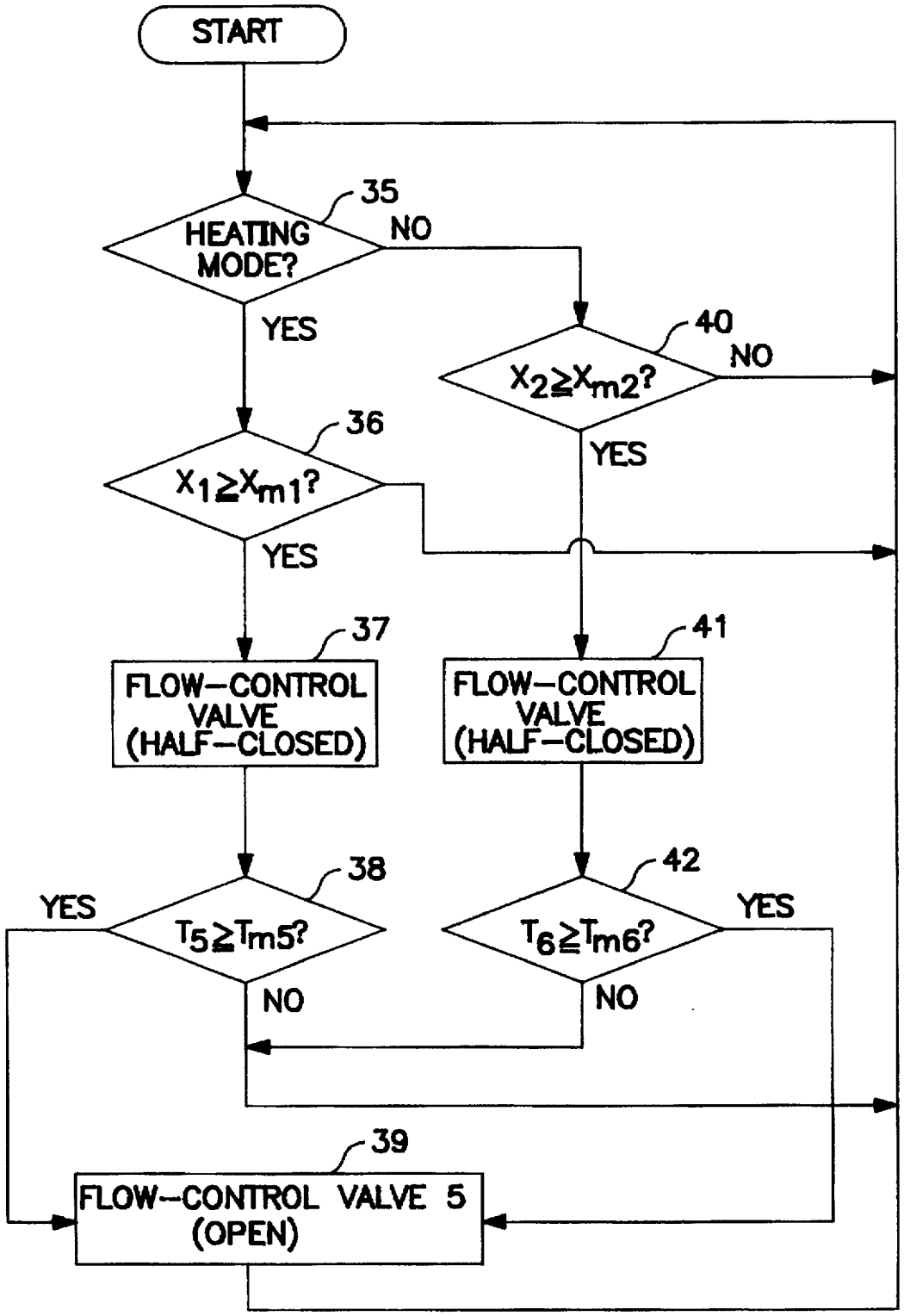
FIG. 16 shows a flow-chart explaining the operation of the controller in accordance with the fourth exemplary embodiment of the present invention.

The operation of thus constructed controller is now explained by referring to FIG. 16. As seen from this flow-chart of the present invention, flow-control valve 5 is controlled so that it is set to [OFF] only when a possibility of indoor-load value higher than the preset value exists in both the cooling and heating mode.

When starting of the operation is commanded by either a remote control or a forced operation signal, the operation of the refrigerator is started, and at the same time, Step-35 shown in FIG. 16 is started. When the signal outputted from operation-mode detection means 19 commands [heating], [YES] is judged and processing continues at Step-36. On the other hand, when [cooling] is commanded, [NO] is judged and processing continues at to Step-40.

In Step-36, indoor-load $X_1$ is derived by conducting a difference operation which determines the difference between the temperature $T_6$ set by indoor-temperature setting device 28 (or the temperature set by remote-controller) and the temperature $T_7$ detected by indoor-temperature detecting means 27, and if a condition of $X_1 \geqq X_{M1}$ is obtained by a comparison operation comparing the indoor-load $X_1$ with the preset load value $X_{M1}$ (e.g. 4000 W), [YES] is judged and processing continues at to Step-37.

In Step-37, the first output-mode memorized in the memory circuit (memory means) is selected by a selection means built within memory 10*c*, flow-control valve 5 is set to [OFF] by a control signal outputted from output-circuit 10*d*, and processing continues at Step-38. If $X_1<X_{M1}$, [NO] is judged and proessing returns to Step-35.

In Step-38, the temperature $T_5$ detected by indoor heat-exchanger temperature detector 18 is compared with the preset temperature $T_{M5}$ (e.g. 65° C.), and if $T_5 \geqq T_{M5}$ is established, a judgment of [YES] is made and processing continues at Step-39. In Step-39, if a relation of $T_5<T_{M5}$ is derived, [NO] is judged and the refrigerating capability is increased by inputting a control signal by which a refrigerant containing the low boiling-point component at a high ratio is introduced, and processing returns to Step-35.

In Step-40, indoor-load $X_2$ is derived by conducting a difference operation determining the difference between the temperature $T_7$ set by indoor-temperature setting device 28 (or the temperature set by remote-controller) and the temperature $T_8$ detected by indoor-temperature detecting means 27. If a condition of $X_2 \geqq X_{M2}$ is obtained by a comparison operation comparing the indoor-load $X_2$ with the preset load $X_{M2}$ (e.g. 4000 W), [YES] is judged and proessing continues at to Step-41.

In Step-41, the first output-mode memorized in the memory circuit (memory means) is selected by the selection means incorporated in memory 10*c*, flow-control valve 5 is set to [OFF] by a control-signal outputted from output-circuit 10*d*, and processing continues at Step-42. If a relation of $X_2 \geqq X_{M2}$ is established, [NO] is judged and processing returns to Step-35. In Step-42, the temperature $T_6$ detected by outdoor heat-exchanger temperature detector 17 is compared with the preset temperature $T_{M6}$ (e.g. 65° C.). If a relation of $T_6 \geqq T_{M6}$ is established, [YES] is judged and processing continues at Step-39. If a relation of $T_6<T_{M6}$ is derived, [NO] is judged and the refrigerating capability is increased by a control signal by which a refrigerant containing the low boiling point component at a high ratio is introduced and processing returns to Step-35.

Each of the above-described steps are now explained. Step-36 is a comparison operation for determining if the indoor-load is higher than the predetermined value or not from the set indoor temperature and the indoor temperature. In Step-37, a control signal for attaining a high refrigerating capability by introducing a refrigerant having a higher composition of low-boiling point component in the refrigerator sets flow-control valve 45 to [ON]. Step-38 is a comparison operation for determining if the pressure of indoor-heat exchanger is greater than a predetermined value or not from the indoor-heat exchanger temperature.

In Step-38, a control signal for turning flow control valve 45 to [ON] is outputted in order to set the refrigerator to normal operation. Step-40 is a comparison operation for determining if the indoor load is greater than the predetermined value or not from the preset indoor temperature and indoor temperature. In Step 41, a control signal turns flow-control valve 5 to [OFF], thereby increasing the refrigerating capability by introducing a refrigerant having a high composition ratio of low boiling-point component. Step-42 is a process to perform a comparison operation for judging if the pressure of outdoor heat-exchanger 47 is higher than the predetermined value or not from the outdoor heat exchanger temperature.

As explained above, both an optimum refrigeration-cycle having a short response time in matching to the required load, and improved safety can be obtained by controlling flow-control valve 5 and by providing a temperature detector to each of indoor heat-exchanger 16 and outdoor heat-exchanger 15.

Embodiment-5

FIGS. 17 to 20 show respectively a diagram of a refrigerating cycle, a block diagram of a control circuit, a block diagram of a controller, and a flow-chart showing the program of the controller realized in the refrigerator of Embodiment-5.

The difference of Embodiment-5 from the previously described Embodiment-4 is a provision of the reheater 4 connected to the bottom of fractionator 3 through the second flow-control valve 42 in order to return the component evaporated in reheater 4 to the bottom of fractionator 3. In addition to this, [open] of Embodiment-5 is specified as a condition where flow-control valve (hereinafter called as the first flow control valve) 5 and the second flow control valve 42 are set to [ON], [half-open] is a condition where the first flow-control valve 5 is set to [OFF], and [full-open] is a condition where the second flow-control valve 42 is set to [OFF]. Moreover, the same devices as those shown in Embodiment-4 are identified by the same notations and the explanations to those are omitted.

Figure 17:
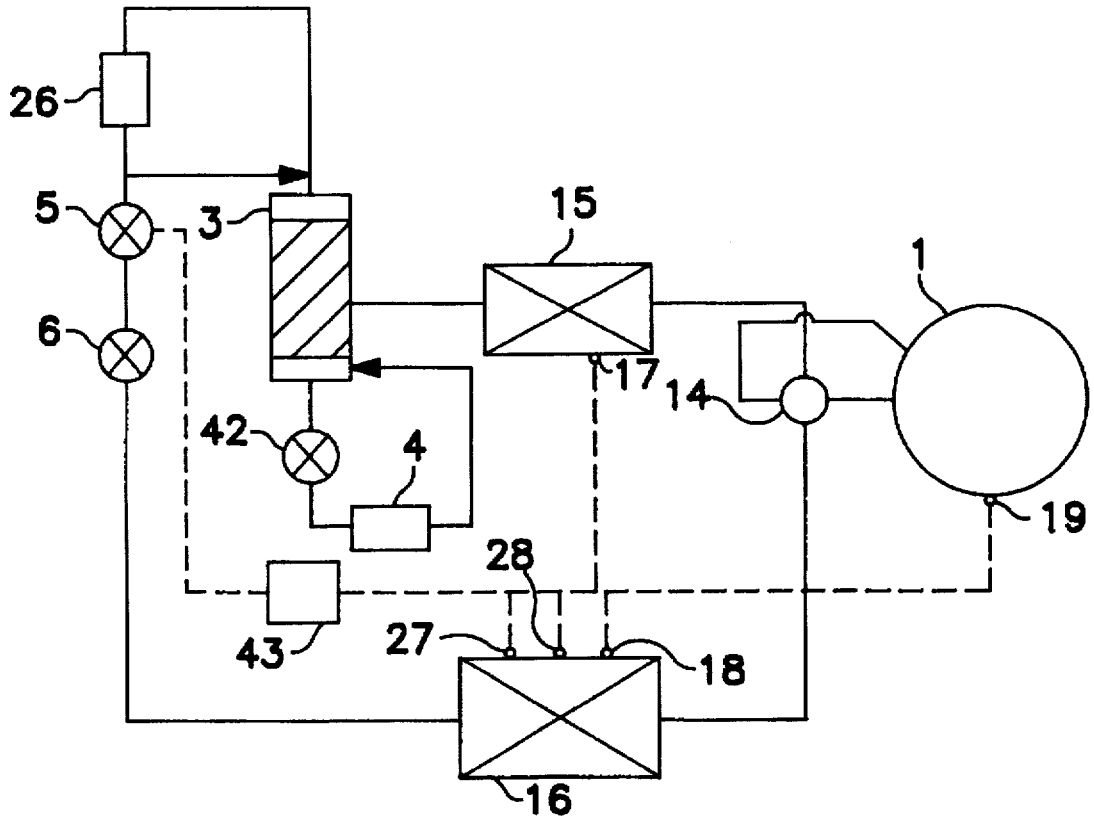
FIG. 17 shows a refrigerating cycle diagram of a refrigerator provided with a controller in accordance with a fifth exemplary embodiment of the present invention.
Figure 18:
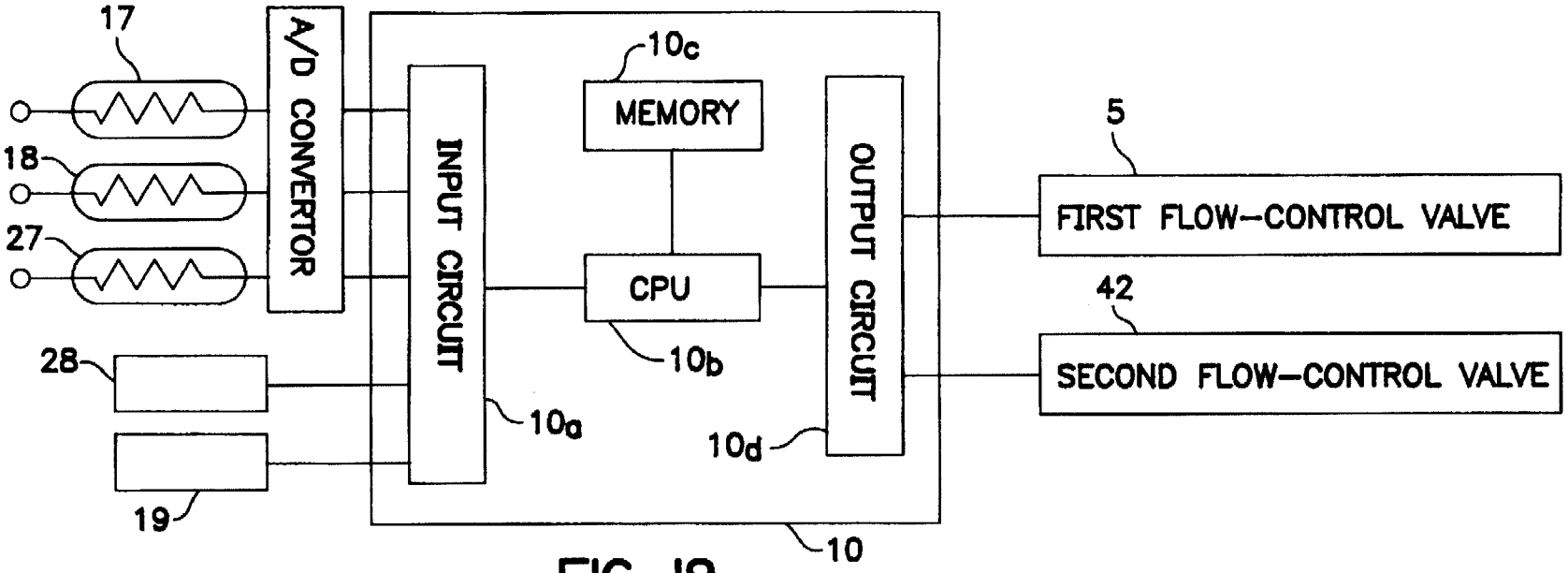
FIG. 18 shows a block diagram of the control circuit incorporated in the controller in accordance with the fifth exemplary embodiment of the present invention.
Figure 19:
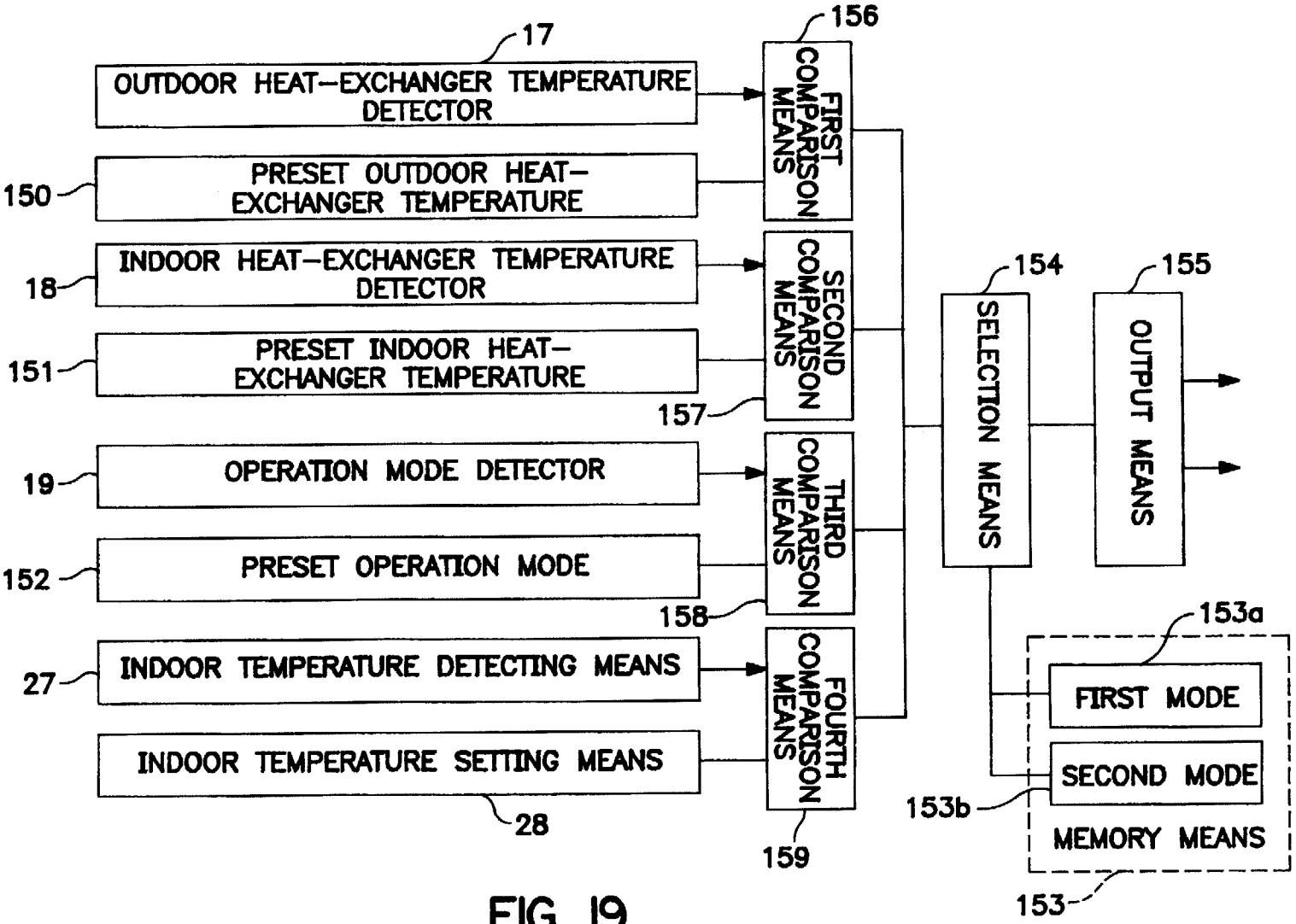
FIG. 19 shows a block diagram of the controller in accordance with the fifth exemplary embodiment of the present invention.

As shown in FIGS. 17 to 19, flow-controller (flow-control valve control means) 43 is comprised of the first to the fourth comparison means, indicated by reference numerals 156, 157, 158 and 159 respectively, which are the same as those shown in Embodiment-4, a difference temperature detection means, and a memory means for memorizing the output-modes controlling the indoor-load determination means and the opening of the first flow-control valve 5 and the second flow-control valve 42, a selection means for selecting one of the output modes memorized in the memory means 153 with first mode 153*a* and second mode 153*b* according to the output-signal generated from the first to fourth comparison means, and output means 155 for outputting a signal to the selection means 154 according to the signals form the first to fourth comparison means and controlling the openings of the first and the second flow control valve 5 and 42, respectively. Preset outdoor heat exchanger temperature is represented by reference numeral 150, preset indoor heat exchange temperature ie represented by reference numeral 151, the present operation mode is represented by reference numeral 152.

Figure 20:
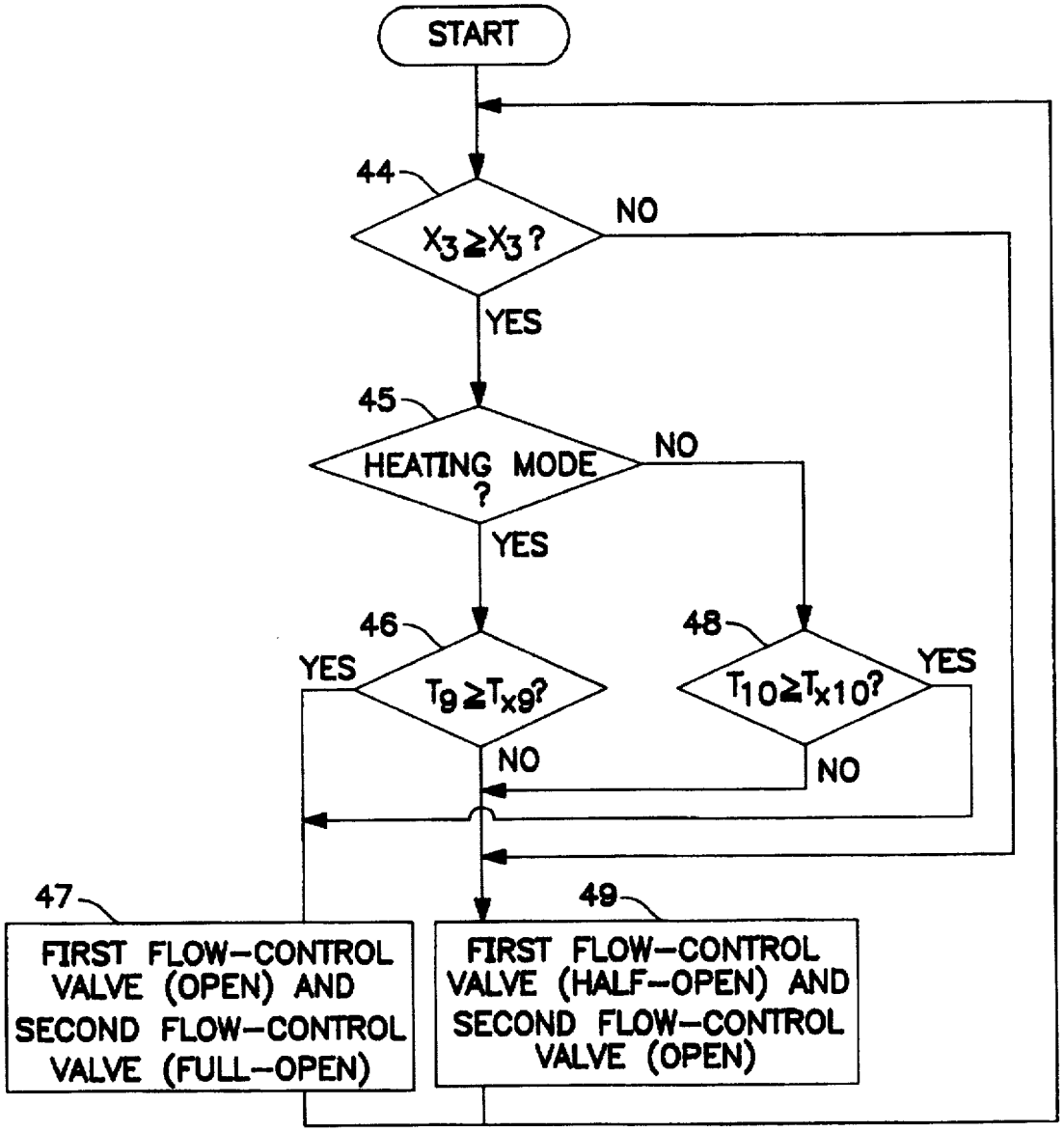
FIG. 20 shows a flow-chart explaining the operation of the controller in accordance with the fifth exemplary embodiment of the present invention.

The operation of thus constructed controller is now explained by referring to FIG. 20. As seen from the flow-chart of the present invention, both the first flow-control valve 5 and the second flow-control valve 42 are controlled so that an optimum coefficient of performance (COP) according to the various conditions of cooling or heating and the indoor load can be obtained.

When a command to start the operation from a remote-controller or a command of forced operation is issued, the operation of refrigerator is started, and at the same time, Step-44 shown in FIG. 20 is executed. In this step, indoor load $X_3$ is derived by determining the difference between the temperature $T_8$ detected by indoor-temperature setter 28 (or the temperature set by the remote-controller) and the temperature $T_9$ detected by indoor-temperature detection means 27.

If a relation of $X_3 \geqq X_{M3}$ is derived from a difference operation determining the difference between the indoor load $X_3$ and the preset $X_{M3}$ (e.g., 4000 W), [YES] is judged and processing continues at Step-45. If a relation of $X_3 < X_{M3}$ is derived, [NO] is judged and processing continues at Step-49. In Step-45, [YES] is judged if the signal outputted from operation-mode detector 19 is [heating], and processing continues at Step-46, while when [NO] is judged, processing continues at Step-48. In Step-46, if a relation of $T_9 \geqq T_{M9}$ is derived from determining the difference between the temperature $T_9$ detected by indoor heat-exchanger temperature detector 18 the preset temperature $T_{M9}$ (e.g., 65° C.), [YES] is judged and processing continues at Step-47. In Step-47, the first flow-control valve 5 is set to [ON] and a control signal introduces a refrigerant containing high-boiling-point component at a high ratio by setting the second flow-control valve 42 to [OFF], and processing returns to Step-44.

In Step-46, if the relation is $T_9 < T_{M9}$, [NO] is judged and processing continues at Step-49. In Step-49, the first flow-control valve 5 is set to [OFF] and a control signal introduces a refrigerant containing low-boiling-point component at a high ratio by setting the second flow-control valve 42 to [OFF], and processing returns to Step-44. In Step-48, if a relation of $T_{10} \geqq T_{M10}$ is derived from a difference operation determining the difference between the temperature $T_{10}$ detected by outdoor heat-exchanger temperature detector 17 and the preset outdoor temperature $T_{M10}$ (e.g., 65° C.), [YES] is judged and processing continues at Step-47. If a relation $T_{10} \geqq T_{M10}$ is derived, [NO] is judged, and processing continues at Step-49.

Each of the above-described steps are now explained. Step-44 is a comparison operation for determining if the indoor-load is higher than the predetermined value or not from the preset indoor temperature and the indoor temperature. Step-45 is a comparison operation for determining if the operation mode is [cooling] or [heating]. Step-46 is a comparison operation for determining if the pressure of indoor heat-exchanger 16 is higher than the preset pressure or not from the indoor heat exchanger temperature. In Step-49, a control signal for introducing a refrigerant containing the low-boiling-point component at a high ratio increasing COP during a period of high load is outputted by setting the first flow-control valve 5 to [OFF] and the second flow-control valve 42 to [ON].

Step-49 is a comparison operation for determining if the pressure of outdoor heat-exchanger 15 is higher than the preset pressure or not from the outdoor heat exchanger temperature, and in Step-47, the operation for decreasing the internal pressure of condenser to a value less than the predetermined value by outputting a control signal by which a refrigerant containing the high-boiling-point component at a high ratio increasing COP is introduced during a period of low load.

As explained above, both an optimum refrigeration-cycle having a short response time for matching to the required load and a safe and wider control capability can be obtained by providing overhead condenser 26 on the top of fractionator 3 and reheater 4 at the bottom of fractionator 3 and by controlling flow-control valve 5 according to the output of temperature detectors provided on each of indoor heat-exchanger 16 and outdoor heat-exchanger 15.

Embodiment-6

FIGS. 21 to 24 show respectively a diagram of a refrigerating cycle, a block diagram of the control circuit of a controller, a block diagram of the controller, and a flow-chart showing the program of the controller realized in the refrigerator of Embodiment-6.

Figure 21:
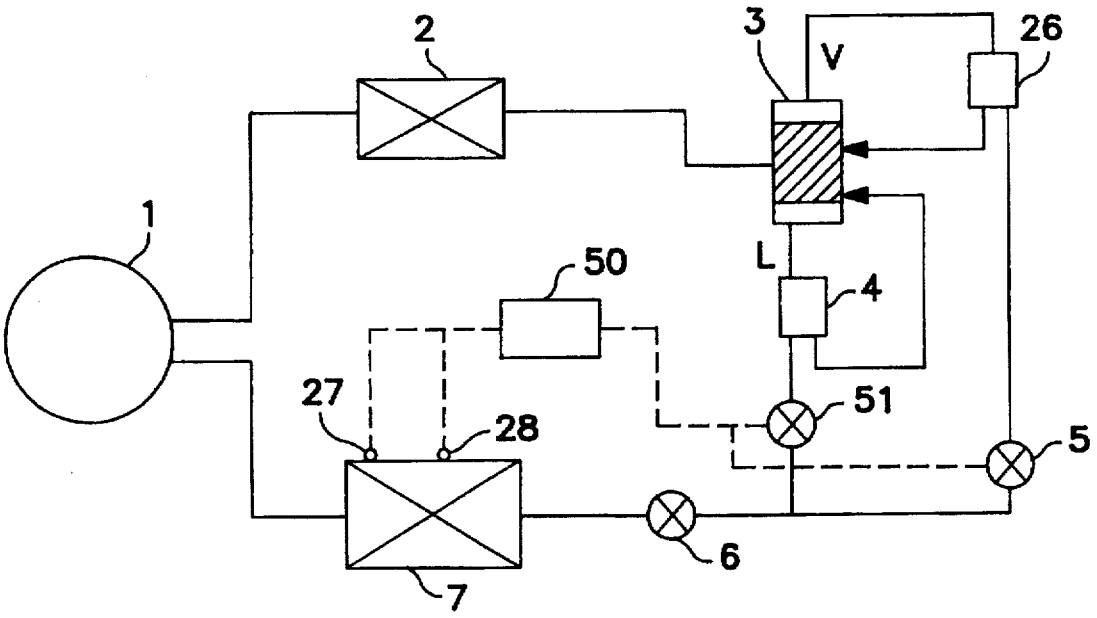
FIG. 21 shows a refrigerating cycle diagram of a refrigerator provided with a controller in accordance with a sixth exemplary embodiment of the present invention.

The devices of Embodiment-6 that are the same as those shown in Embodiments-1 to -5 are identified by the same notations, and the explanations for those are omitted here. As shown in FIG. 21, the refrigerating cycle is comprised of variable volume compressor 1, condenser 2, fractionator 3, overhead condenser 26 provided on the top of fractionator 3, the first flow-control valve 5, the first throttle device 6, and evaporator 7 connected in a form of a ring.

In addition to these, two circuits in which the refrigerant liquified in overhead condenser 26 is introduced, one of which acts as a return circuit to the top of fractionator 3 and the other connected to a circuit connecting the first flow control valve 5 to the first throttle device 6 through the second flow control valve 51, are provided together with a control-circuit connecting indoor-temperature detector 27 for detecting the indoor-temperature (environmental temperature of condenser) 27 and indoor-temperature setter 28 for setting the indoor temperature at a desired temperature, and flow-controller 50 for controlling the first and second flow control valves 5 and 51. The first and second flow control valves 5 and 51 are opened when [ON] is shown and are closed when [OFF] is shown.

The operation of thus constituted refrigerator employing a separated high-boiling point refrigerant is now explained.

The refrigerant vapor compressed by compressor 1 is introduced in fractionator 3 after it becomes a partially condensed liquid by condenser 2, and bottom-liquid L having a high composition of high-boiling component is therein separated. The bottom liquid L is then heated and turned into saturated vapor which is circulated to the bottom of fractionator 3 by the action of the second flow-control valve 51. Refrigerant V containing more of the low-boiling point component is introduced into condenser 7 from the top of fractionator through overhead condenser 26 by the action of the first flow control valve 5.

Figure 22:
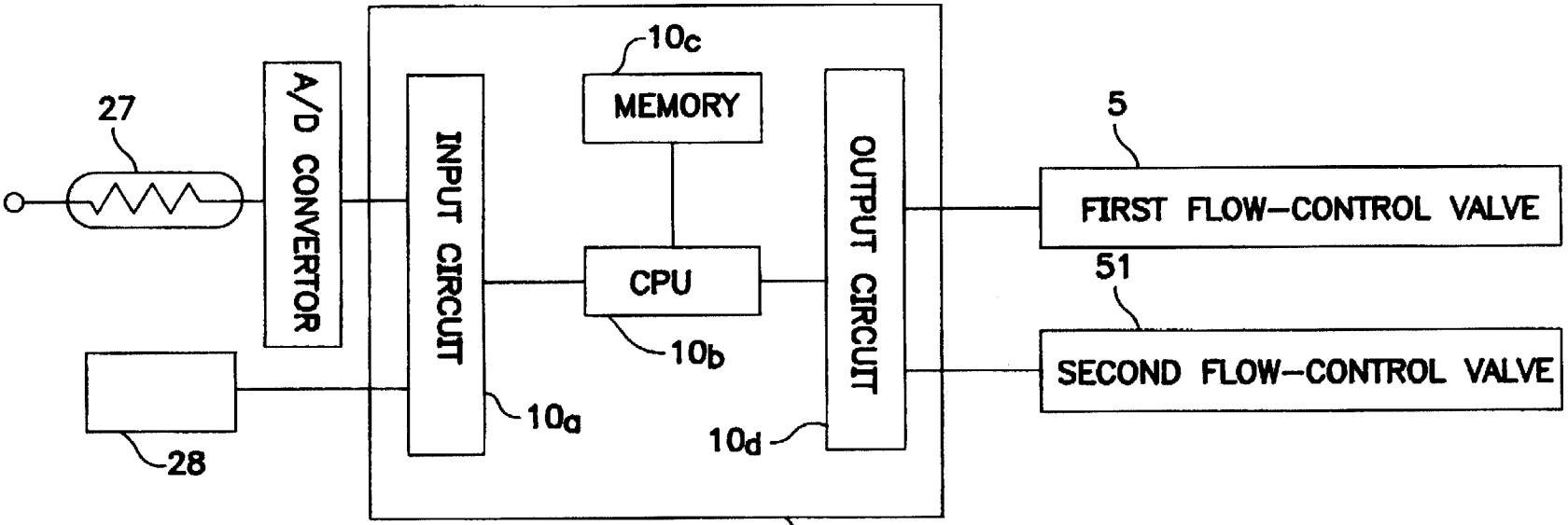
FIG. 22 shows a block diagram of the control circuit incorporated in the controller in accordance with the sixth exemplary embodiment of the present invention.
Figure 23:
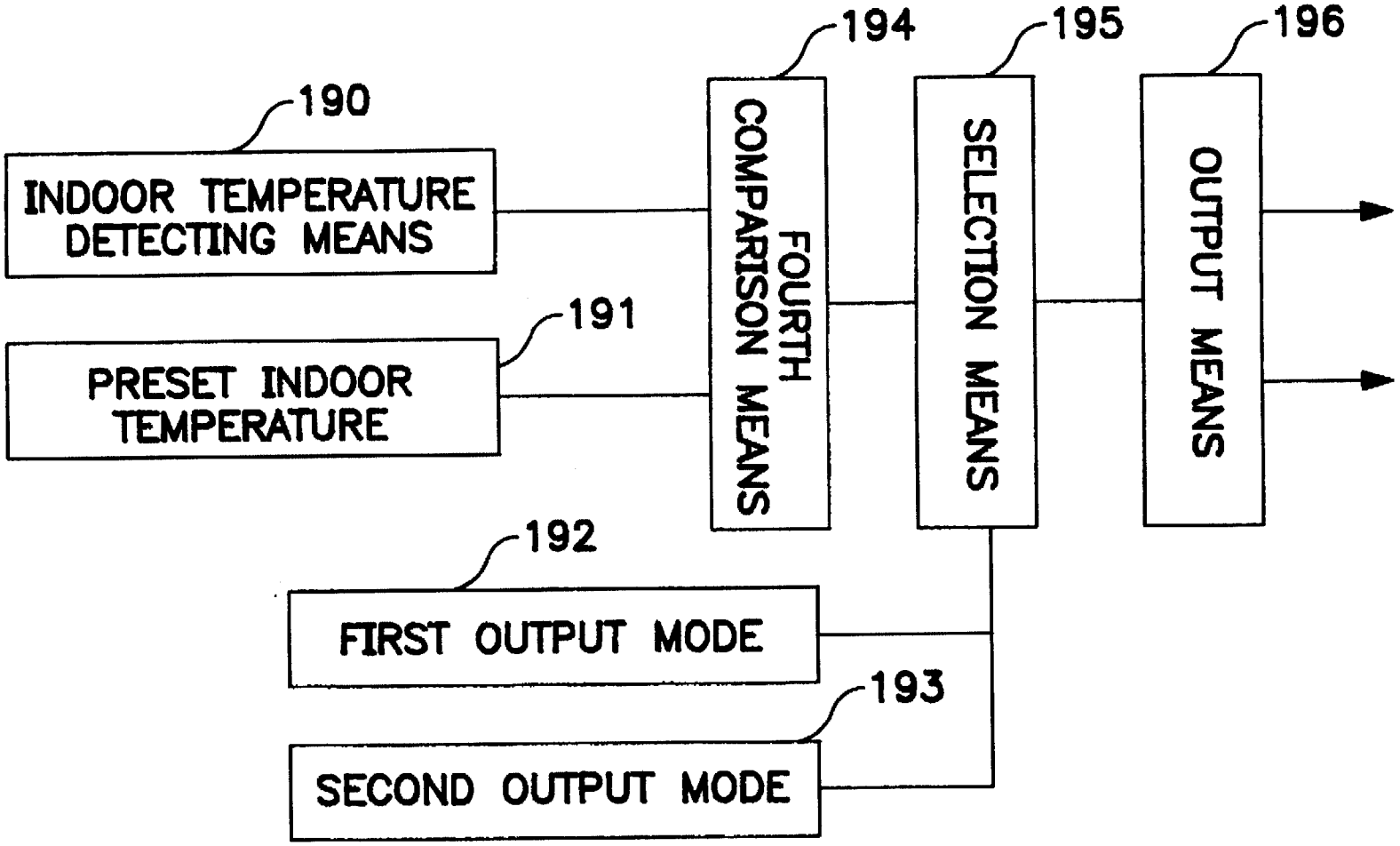
FIG. 23 shows a block diagram of the controller in accordance with the sixth exemplary embodiment of the present invention.

As shown in FIGS. 22 and 23, LSI 10 corresponds to the fourth comparison means incorporated therein, and compares the temperature detected by indoor-temperature detector 27 and outputted from the A/D converter with the temperature outputted from indoor-temperature setter (remote controller) 28, and outputs a control signal. A memory means for memorizing the output modes controlling the openings of the first and second flow-control valves 5 and 51 and a selection means for selecting one of the modes memorized in the memory means by the signal outputted from the fourth comparison means is also provided.

Thus, controller 50 is constituted of LSI 10 for outputting a signal from the selection means, selecting one of the output modes according to the signal from the fourth comparison means, and controlling the openings of first and second flow control valves 5 and 51. Here, [ON] means the "open" state of first and second flow-control valves 5 and 51 while [OFF] means the "close" state of these flow-control valves.

Indoor temperature detecting means is represented by reference numeral 190. Preset indoor temperature means is represented by the reference numeral 191. The memory means has a first output mode 192 and a second output mode 193. The fourth comparison means is represented by reference numeral 194, the selection means is represented by reference numeral 195, and the output means is represented by reference numeral 196.

Figure 24:
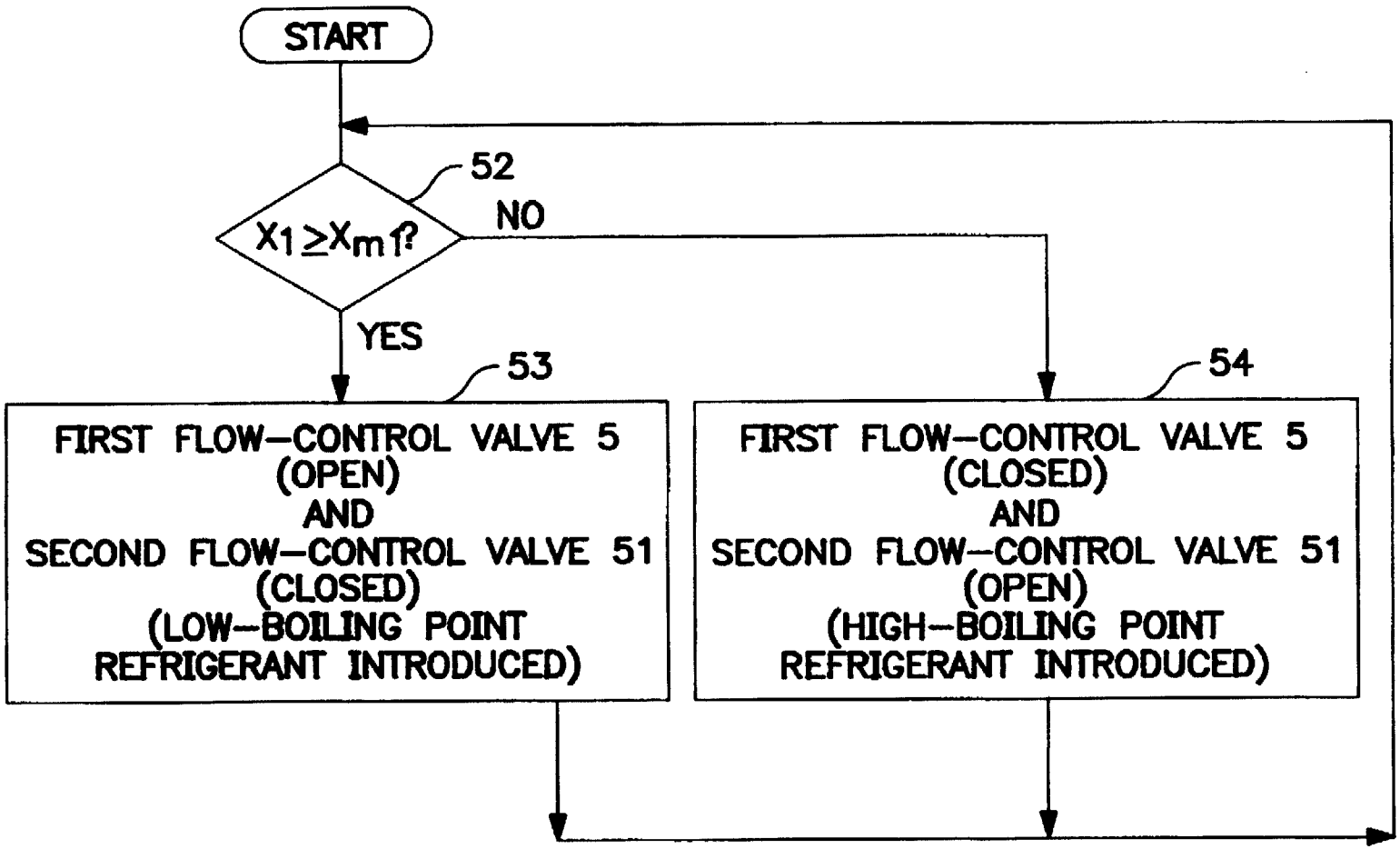
FIG. 24 shows a flow-chart explaining the operation of the controller in accordance with the sixth exemplary embodiment of the present invention.

The operation of thus constituted refrigerator controller is now explained by referring to FIG. 24.

As seen from the flow-chart of FIG. 24, with the present invention, the openings of first and second flow-control valves 5 and 51, respectively, are controlled so that an optimum COP in accordance to the indoor-load can be obtained constantly.

When a command to start the operation from a remote-controller or a command of forced operation is issued, the operation of refrigerator is started, and at the same time, Step-52 shown in FIG. 24 is executed. In Step-52, indoor load $X_1$ is determined from a difference operation comparing temperature $T_{M1}$ (or the temperature set by remote-controller) detected by indoor-temperature setting means 28 with the temperature $T_1$ (or the temperature detected by indoor temperature detector 27). [YES] is judged if a relation of $X_1 \geqq X_{M1}$ is derived from a difference operation comparing indoor-load $X_1$ with the preset load $X_{M1}$ (e.g., 4000 W), and processing continues at Step-53.

In Step-53, the first output mode memorized in the memory means is selected by a selection means incorporated in memory 10*c*, and a control signal is outputted from output circuit 10*d*, setting the first flow control valve 5 to [ON] and the second flow-control valve 51 to [OFF], and processing returns to Step-52. In a case where a relation of $X_1 < X_{M1}$ is obtained, a judgment of [NO] is made, and processing continues at Step-54. In Step-54, the second output mode memorized in the memory means is selected by a selection means built in memory 10*c*, an output signal is outputted from output circuit 10*d*, setting the first flow-control valve 5 at [OFF] and the second flow-control valve 51 at [ON], and processing returns to Step-52.

Each of these steps are now explained. Step-40 is a comparison operation for determining if the indoor-load is higher than the predetermined value or not from the preset indoor temperature and the indoor temperature. In Step-53, a control signal is outputted thereby setting the first flow-control valve 5 to [ON] and the second flow-control valve 51 to [OFF] in order to introduce a refrigerant containing the low-boiling point component at a high ratio increasing refrigeration capability. In Step-54, a control signal is outputted, thereby setting the first flow-control valve 5 to [OFF] and the second flow-control valve 51 to [ON] for introducing a refrigerant containing the high-boiling point component at a high ratio in order to operate the refrigerator at the normal condition.

As explained above, an optimum refrigeration-cycle of high COP and an improved amenity can be obtained by providing overhead condenser 26 on the top of fractionator 3 and reheater 4 at the bottom of the same, and by controlling the first and second flow-control valves 5 and 51 according to the indoor load.

Embodiment-7

FIGS. 25 to 28 show respectively a diagram of a refrigerating cycle, a block diagram of the control circuit provided within the controller, a block diagram of the controller, and a flow-chart showing the program of the controller realized in the refrigerator of Embodiment-7. The difference from Embodiment-6 is only a provision of condenser temperature detection means 8. Moreover, the devices that are the same as those shown in Embodiment-6 are identified by the same notations and their description is omitted.

Figure 25:
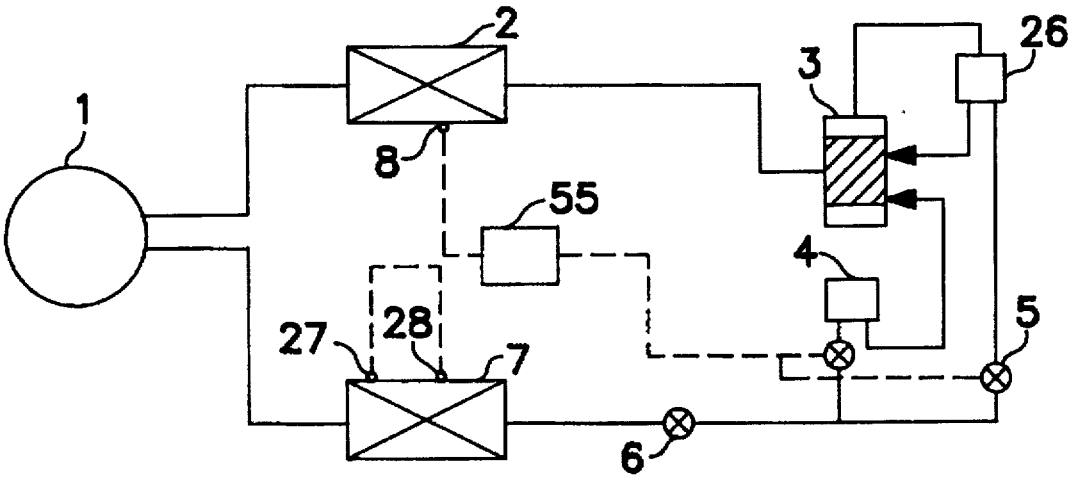
FIG. 25 shows a refrigerating cycle diagram of a refrigerator controlled by a controller in accordance with a seventh exemplary embodiment of the present invention.
Figure 26:
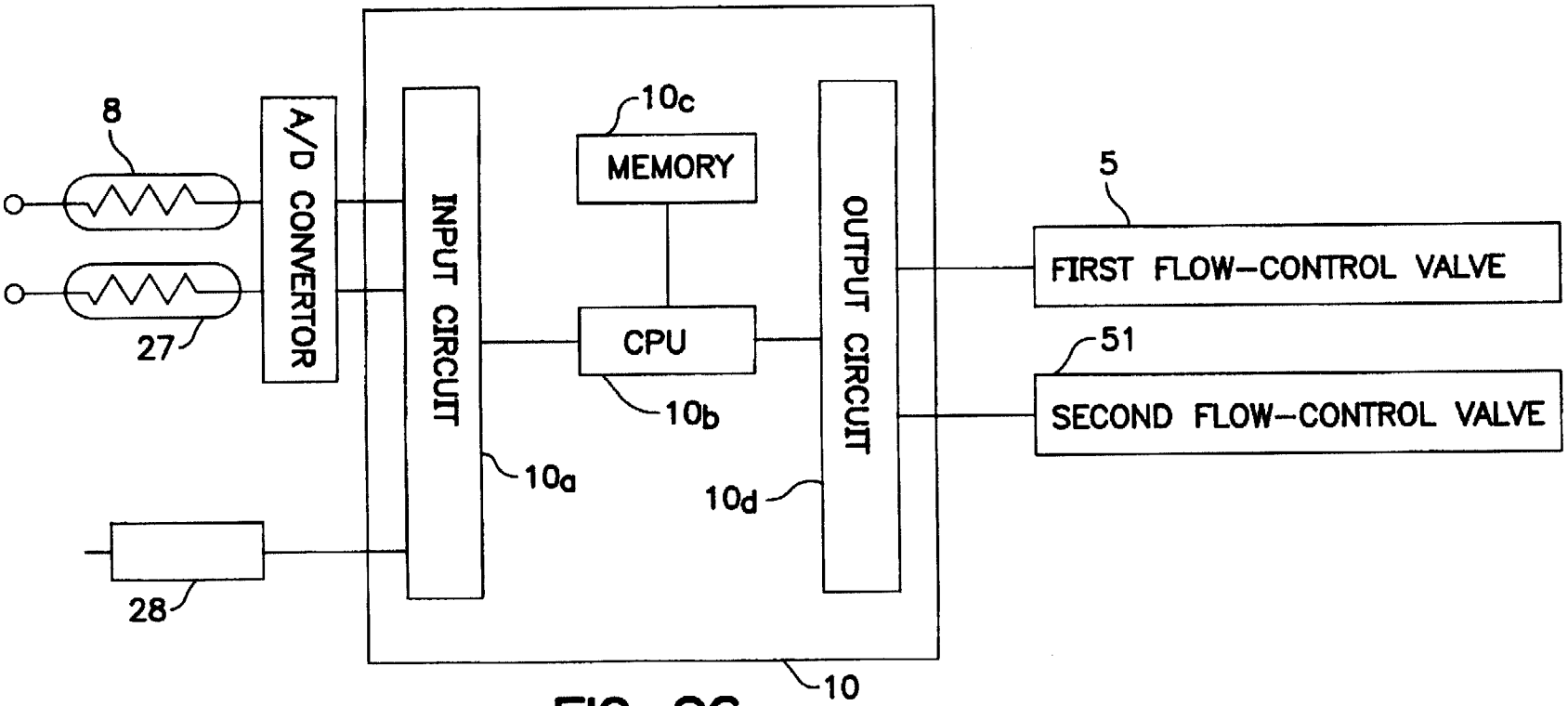
FIG. 26 shows a block diagram of the control circuit controlled by the controller in accordance with the seventh exemplary embodiment of the present invention.
Figure 27:
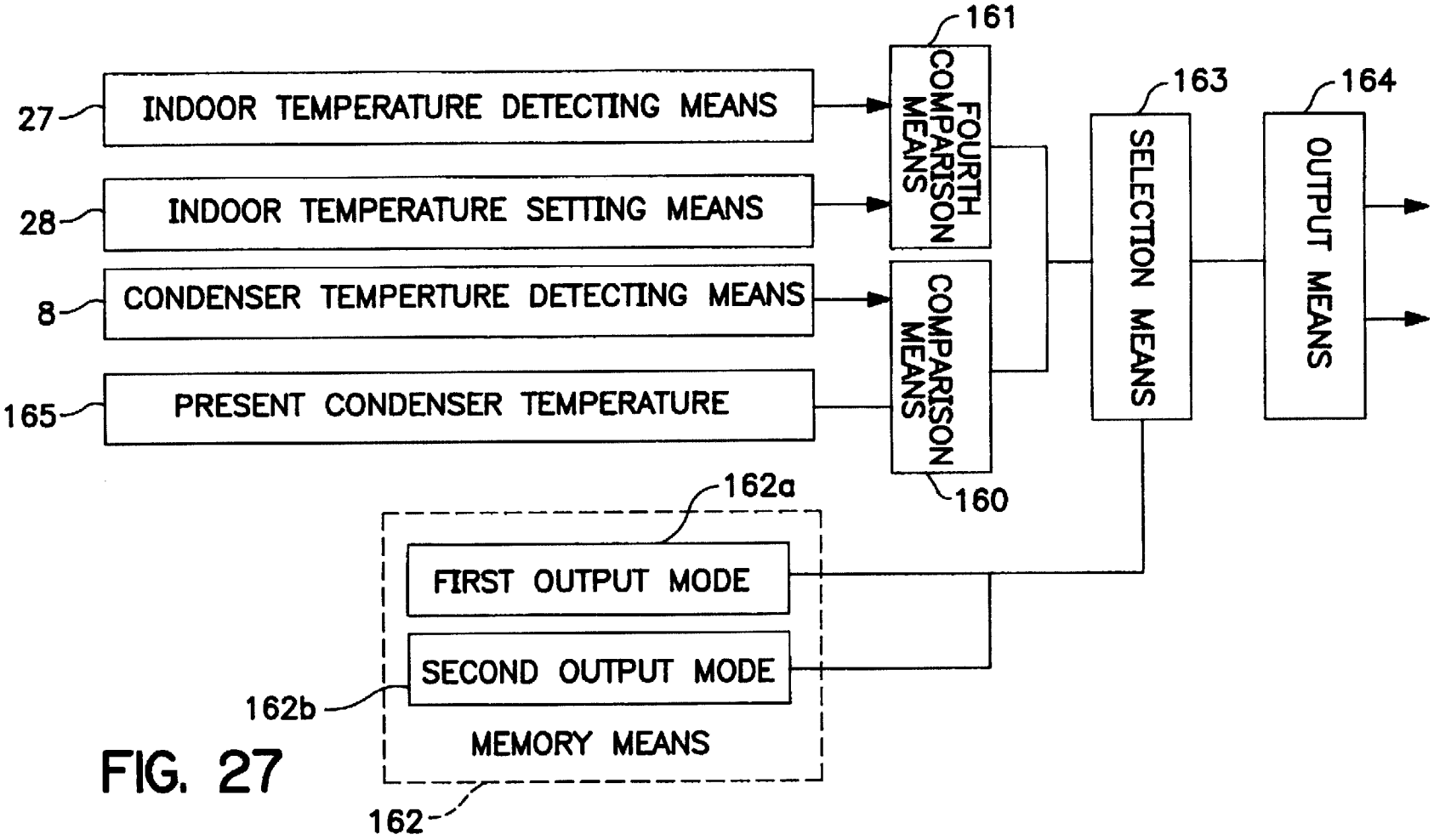
FIG. 27 shows a block diagram of the controller in accordance with the seventh exemplary embodiment of the present invention.

As shown in FIG. 25 to 27, the flow-controller 55 is comprised of a comparison means 160 which is the same as that shown in Embodiment-1, the fourth comparison means 161 which is the same as that shown in Embodiment-3, a memory means 162 with a first mode 162*a* and a second mode 162*b* for memorizing the output modes and controlling the openings of the first and the second flow-control valves 5 and 51, a selection means 163 for selecting one of the output modes memorized in the memory means from the output signals from the comparison means and the fourth comparison means, and an output means 164 for outputting a signal of the selection means according to the signals from the comparison means and the fourth comparison means, and for controlling the openings of the first and second flow-control valves 5 and 51. The preset condenser temperature is represented by reference numeral 165.

Figure 28:
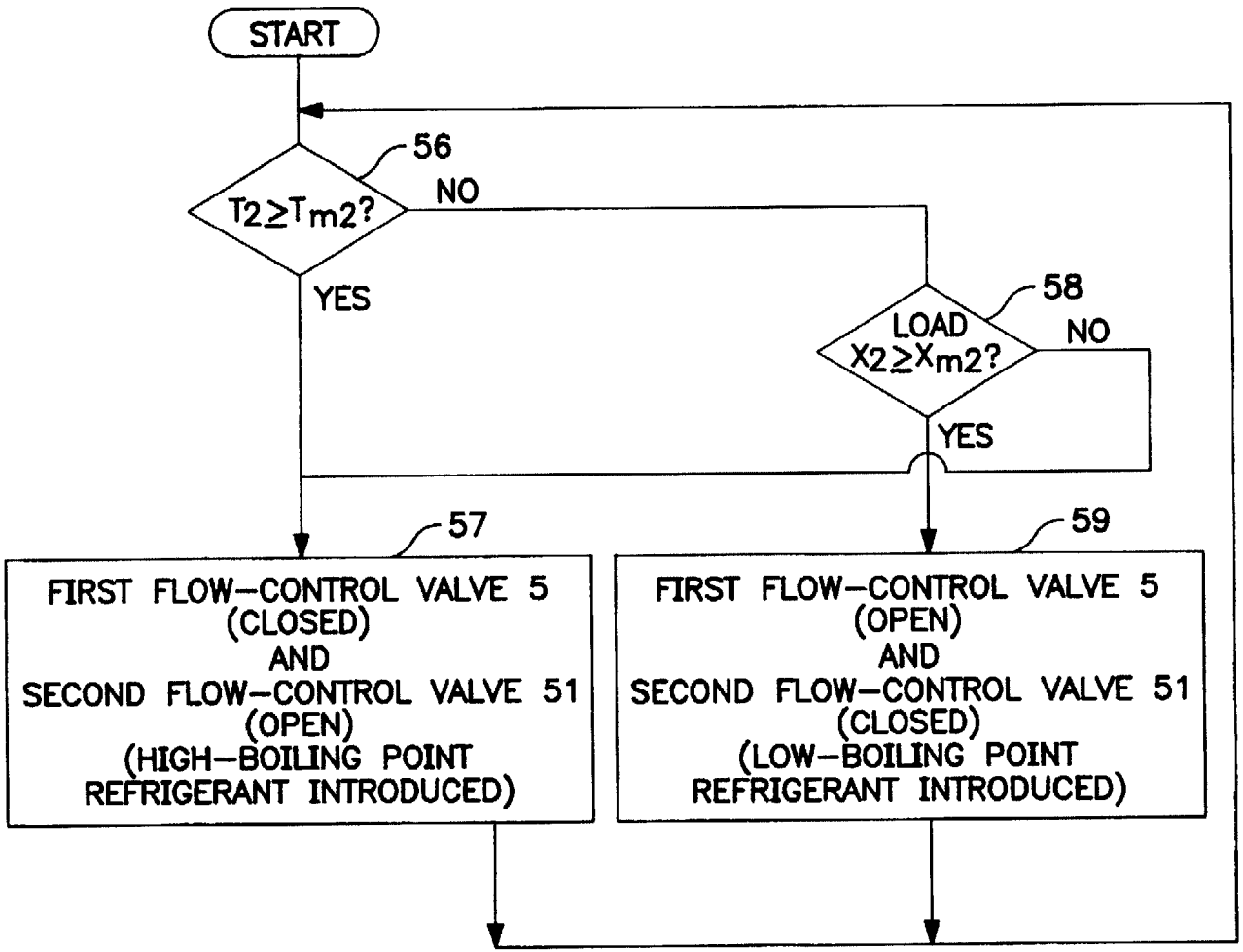
FIG. 28 shows a flow-chart explaining the operation of the controller in accordance with the seventh exemplary embodiment of the present invention.

Referring to FIG. 28, there is shown a flow-chart, and the operation of thus constituted refrigerator controller is now explained.

As seen from the flow-chart of FIG. 28, the first and the second flow-control valves 5 and 51 are controlled in accordance with the indoor-load and condenser-temperature in order to realize a safe and optimum COP.

When a command to start operation is made from a remote-controller or a command of forced operation is issued, the operation of refrigerator is started, and at the same time, Step-56 shown in FIG. 28 is executed. In Step-56, a difference operation for comparing the temperature $T_2$ detected by condenser temperature detector 8 with the preset temperature $T_{M2}$ (e.g., 65° C.) is conducted, and if a relation of $T_2 \geqq T_{M2}$ is obtained, [YES] is judged, and processing continues at Step-57. In Step-57, a control signal is outputted from output circuit 10*d*, and by this, the first flow-control valve 5 is set to [OFF] and the second flow-control valve 51 is set to [ON], and processing returns to Step-56. If a relation of $T_2 < T_{M2}$ is obtained, a judgment of [NO] is made, and processing continues at Step-58.

In Step-58, indoor load $X_2$ is derived from a difference operation comparing the temperature $T_{M2}$ (or the temperature set by remote-control) detected by indoor temperature setter 28 with the temperature $T_3$ detected by indoor temperature detector 27, and if a relation $X_2 \geqq X_{M2}$ is obtained from a difference operation comparing indoor load $X_2$ with preset load $X_{M2}$, [YES] is judged, and processing continues at Step-59.

In Step-59, the first output mode is selected by a selection means memorized in memory 10*c* and flow-control valve 5 is set to [ON] and the second flow-control valve 51 is set to [OFF] by the output signal outputted from output circuit 10*d*, and processing returns to Step-56. If a relation of $X_2 < X_{M2}$ is obtained, [NO] is judged, and processing continues at Step-57. In Step-57, the second output mode memorized in memory 10*c* is selected by a selection means, and a flow-control valve 51 is set to [ON] by the output signal outputted from output-circuit 10*d*, and processing returns to Step-56.

Each of these steps are now explained. Step-56 is a comparison operation for determining if the pressure of condenser 2 is higher than the predetermined value or not from the condenser temperature. In Step-57, a control signal is outputted, thereby setting the first flow-control valve 5 to [OFF] and the second flow-control valve 51 to [ON] in order to introduce a refrigerant containing the high-boiling point component at a high ratio to decrease the condenser pressure below a predetermined value. In Step-58, a comparison for operation determining if the indoor load is higher than a preset value from the set indoor-temperature and indoor-temperature is conducted, and in Step-59, a control signal is outputted, thereby setting the first flow-control valve 5 to [ON] and the second flow-control valve 51 to [OFF] to introduce a refrigerant containing the low-boiling point component at a high ratio in order to increase the refrigerating capability.

As above-explained, a safe and optimum refrigeration-cycle of high COP can be obtained by providing overhead condenser 26 on the top of fractionator 3 and reheater 4 at the bottom of the same, and by controlling the first and second flow-control valves 5 and 51 according to the indoor load.

Embodiment-8

Figure 29:
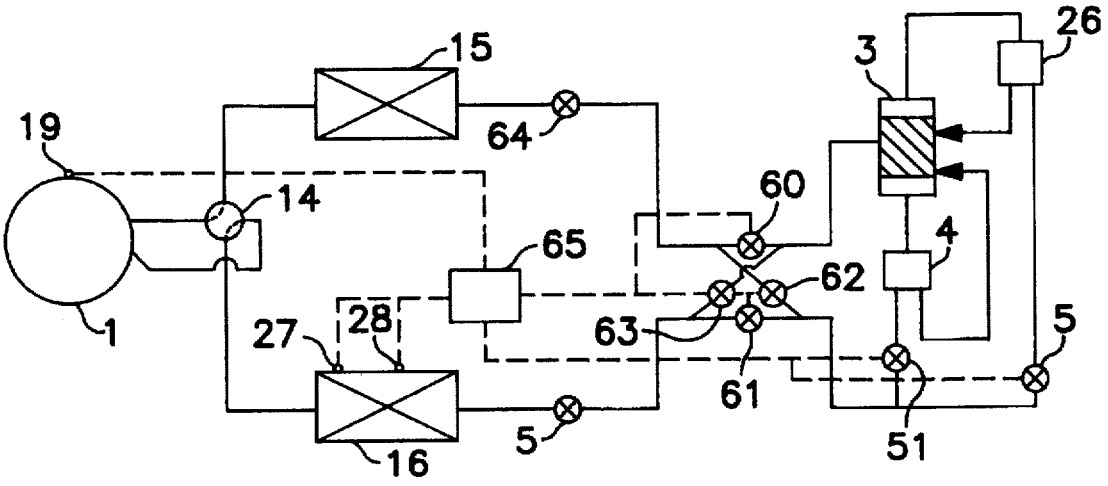
FIG. 29 shows a refrigerating cycle diagram of refrigerator controlled by a controller in accordance with an eighth exemplary embodiment of the present invention.

FIGS. 29 to 32 show respectively a diagram of a refrigerating cycle, a block diagram of the control circuit provided in the controller, a block diagram of the controller, and a flow-chart showing the program of the controller realized in the refrigerator of Embodiment-8. As shown in FIG. 29, the difference from Embodiment-6 is the provision of outdoor heat-exchanger 15 instead of the condenser, indoor heat-exchanger 16 instead of the evaporator, and furthermore, provision of four-way valve 14, third, fourth, fifth, and sixth flow-control valves, 60, 61, 62, and 63, respectively, and the second throttle device 64, and a provision of operation-mode detector 19. Moreover, the devices which are the same as those shown in Embodiment-6 are identified by the same notations, and the explanations are omitted.

Figure 30:
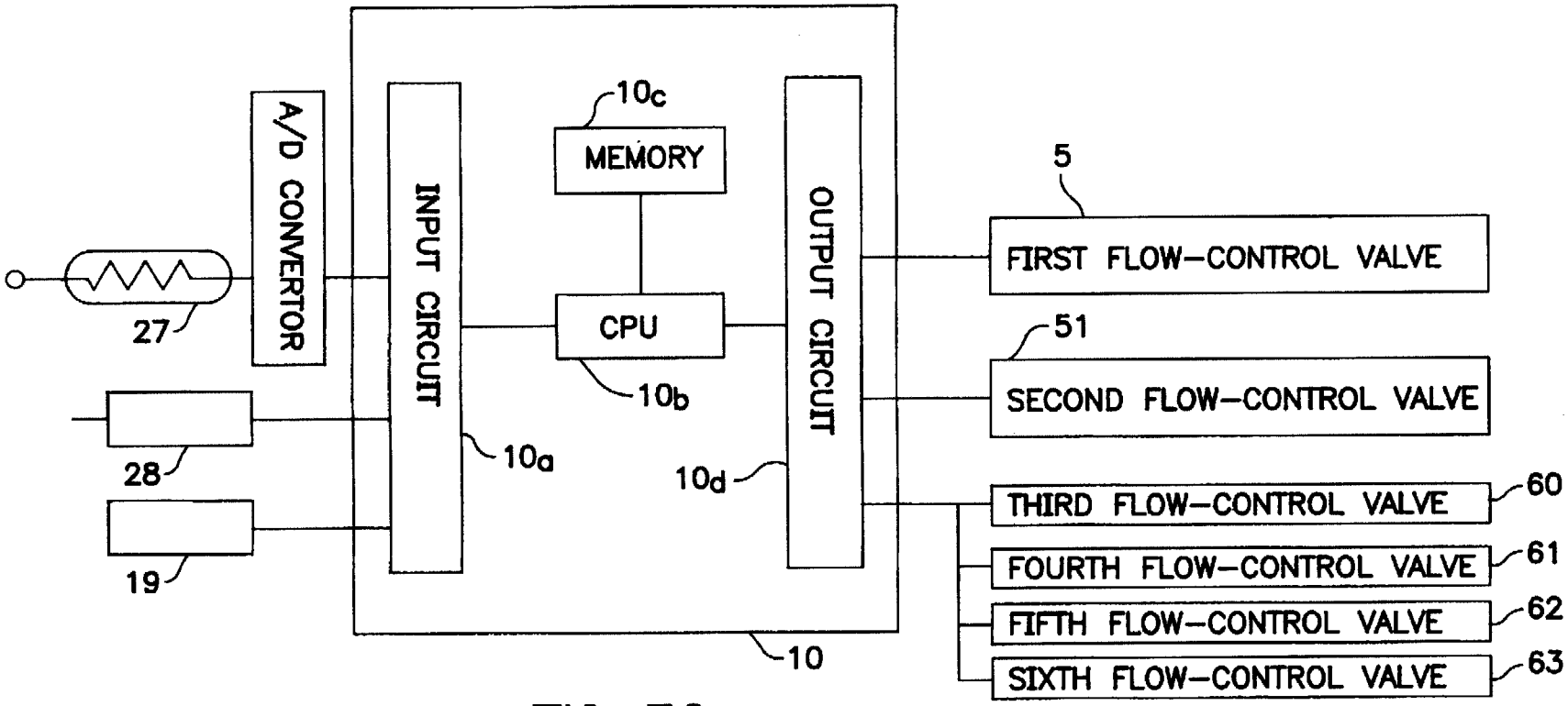
FIG. 30 shows a block diagram of the control circuit provided in the controller in accordance with the eighth exemplary embodiment of the present invention.
Figure 31:
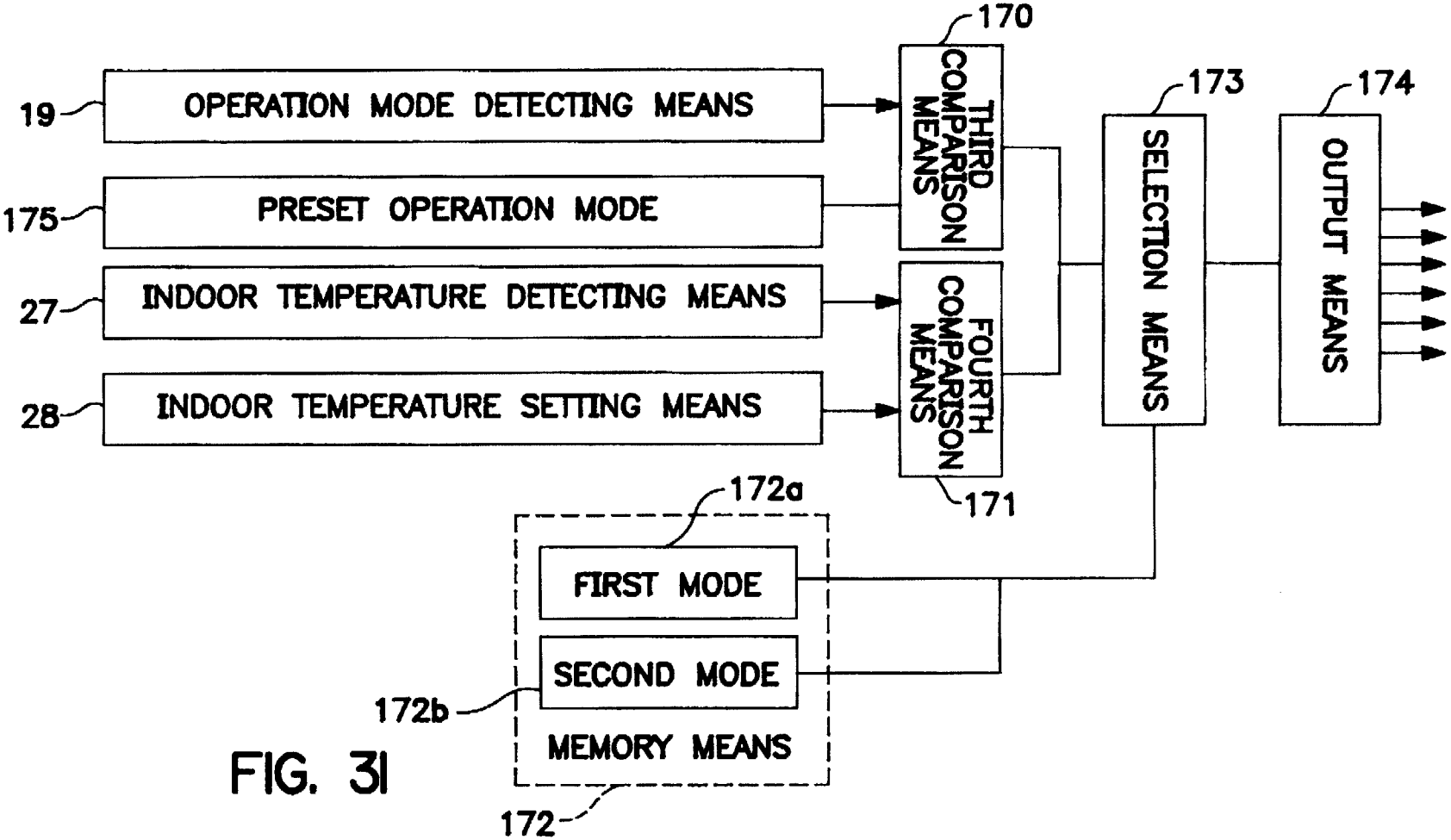
FIG. 31 shows a block diagram of the controller in accordance with the eighth exemplary embodiment of the present invention.

As shown in FIG. 29 to FIG. 31, flow-controller 65 is comprised of third 170 and fourth comparison means 171 which are the same as that shown in Embodiment-2 and Embodiment-3 respectively, a memory means 172 with a first mode 172*a* and a second mode 172*b* for memorizing the output modes and for controlling the openings of the first to the sixth flow-control valves 60 to 63, a selection means 173 for selecting one of the output modes memorized in the memory means 174 by the output signals outputted from the third and fourth comparison means, and an output means for outputting a signal to the selection means according to the signals from the third and fourth comparison means, and controlling the openings of the first to sixth flow-control valves 60 to 63. Preset operation mode is indicated by reference numeral 175.

Figure 32:
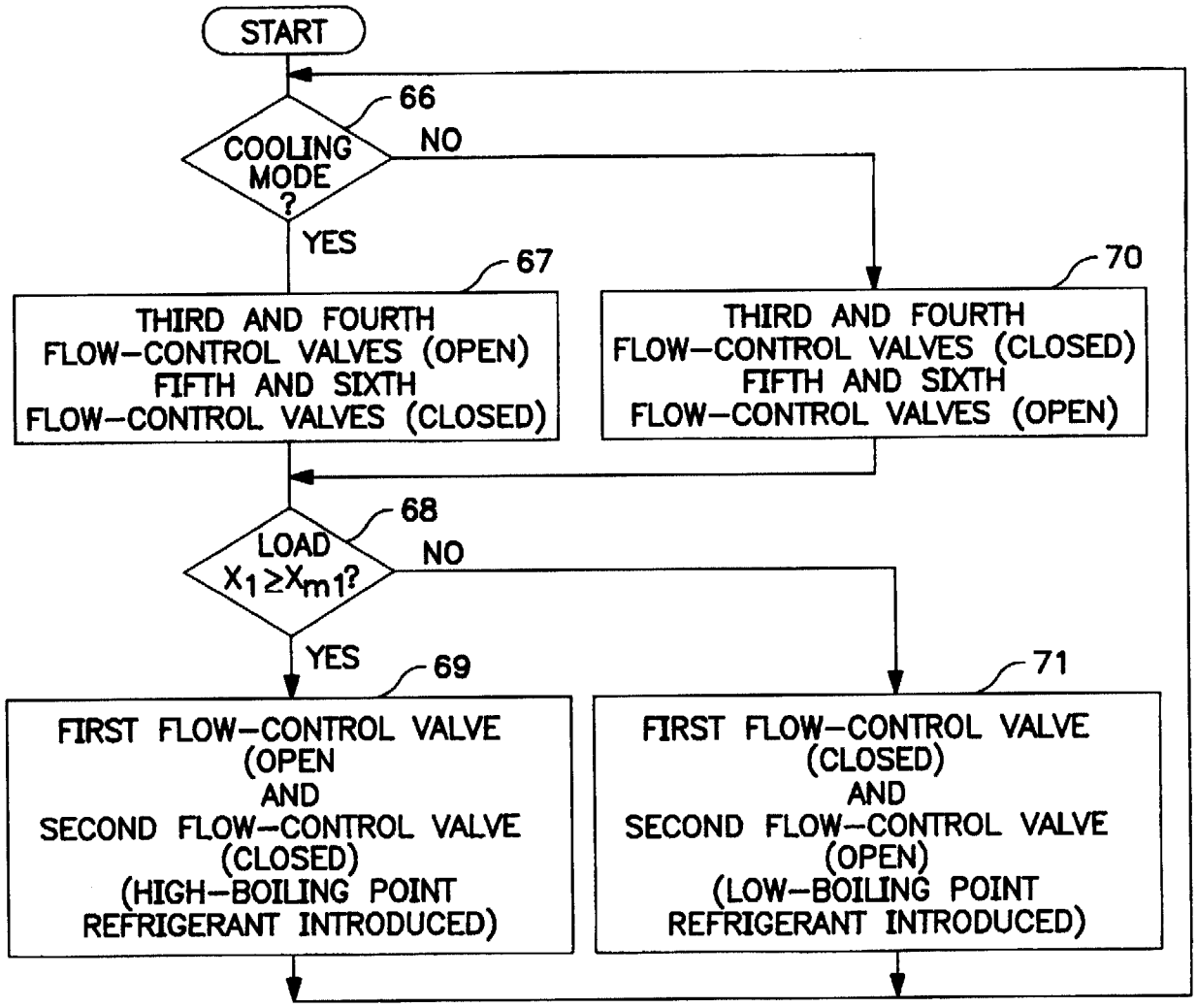
FIG. 32 shows a flow-chart explaining the operation of the controller in accordance with the eighth exemplary embodiment of the present invention.

The operation of thus constituted controller is now explained by referring to the flow-chart of FIG. 32. As seen from this flow-chart, the first to sixth flow-control valves 60 to 63 are controlled in a wide operation range in order to realize an optimum COP.

When a start operation command is made from a remote-controller or a command of forced operation is issued, the operation of refrigerator is started, and at the same time, Step-66 shown in FIG. 32 is executed. In Step-66, if the output of operation mode detector 19 shows [cooling], [YES] is judged and processing continues at Step-67. In Step-67, a control signal is outputted from output-circuit 10*d*, thereby setting the third and fourth control valves 62 and 63 to [OFF], and processing continues at Step-68. In a case of [heating], [NO] is judged, and processing continues at Step-70.

In Step-70, a control signal is outputted from output circuit 10*d*, third and fourth flow-control valves 60 and 61 are set to [OFF], and fifth and sixth flow-control valves 62 and 63 are set to [ON], and processing continues at Step-68. In Step-68, a difference operation comparing the temperature $T_{M4}$ (or the temperature set by remote-controller)

detected by indoor temperature setter 28 with the temperature $T_4$ is conducted in order to derive the indoor load, and if a relation of $T_2 \geqq T_{M2}$ is obtained from a comparison operation comparing indoor load $X_3$ with preset load $X_{M3}$ (e.g., 4000 W), [YES] is judged, and processing continues at Step-69.

In Step-69, the first output-mode memorized in the memory means is selected by the selection means incorporated in memory 10*c*, and a control signal is outputted form output-circuit 10*d*, and by this, the first flow-control valve 5 is set to [ON] and the second flow-control valve 51 is set to [OFF], and processing returns to Step-66. If a relation $X_2 < X_{M2}$ is obtained, [NO] is judged, and processing continues at Step-71. In Step-71, the second output-mode is selected by the selection means incorporated in memory 10*c*, and a control signal is outputted from output-circuit 10*d*, and by this, the first flow-control valve 5 is set to [OFF] and the second flow-control valve 51 is set to [ON], and processing returns to Step-66.

Each of these steps are now explained. Step-66 is a step to judge if it is [cooling] or [heating]. In Step-67, the third to sixth flow-control valves 60 to 63 are controlled in order to construct a refrigerating cycle, and in Step-68, a comparison operation for determining if the indoor load from the indoor temperature condenser 2 is higher than the predetermined value or not from the predetermined indoor temperature and the indoor temperature is executed. In Step-69, a control signal is outputted for setting first flow-control valve 5 to [ON] and the second flow-control valve 51 to [OFF] in order to introduce a refrigerant containing the low-boiling point component at a high ratio, thereby increasing the refrigerating capability. In Step-71, a control signal is outputted for setting the first flow-control valve 5 to [OFF] and the second flow-control valve 51 to [ON] in order to introduce a refrigerant containing the high-boiling point component at a high ratio.

As above-explained, an optimum refrigeration-cycle of high COP according to indoor load can be obtained by providing overhead condenser 26 on the top of fractionator 3 and reheater 4 at the bottom of the same, four-way valve 19, and by controlling the first to sixth flow-control valves in accordance with the indoor load.

Embodiment-9

FIGS. 33 to 36 respectively show a diagram of a refrigerating cycle, a block diagram of the control circuit provided in the controller, a block diagram of the controller, and a flow-chart showing a program of the controller realized in the refrigerator of Embodiment-9. The difference of Embodiment-9 from Embodiment-8 is the provision of outdoor heat-exchanger temperature detector 17 and indoor heat-exchanger temperature detector 18. The devices which are the same as those shown in Embodiment-8 are identified by the same notations, and the explanations to those are omitted.

Figure 33:
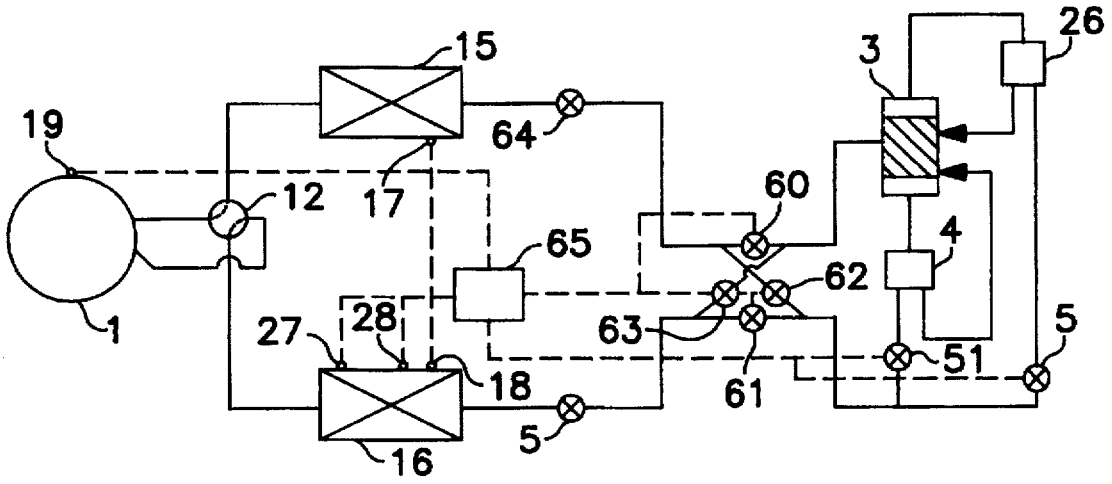
FIG. 33 shows a refrigerating cycle diagram of a refrigerator controlled by a controller in accordance with a ninth exemplary embodiment of the present invention.
Figure 34:
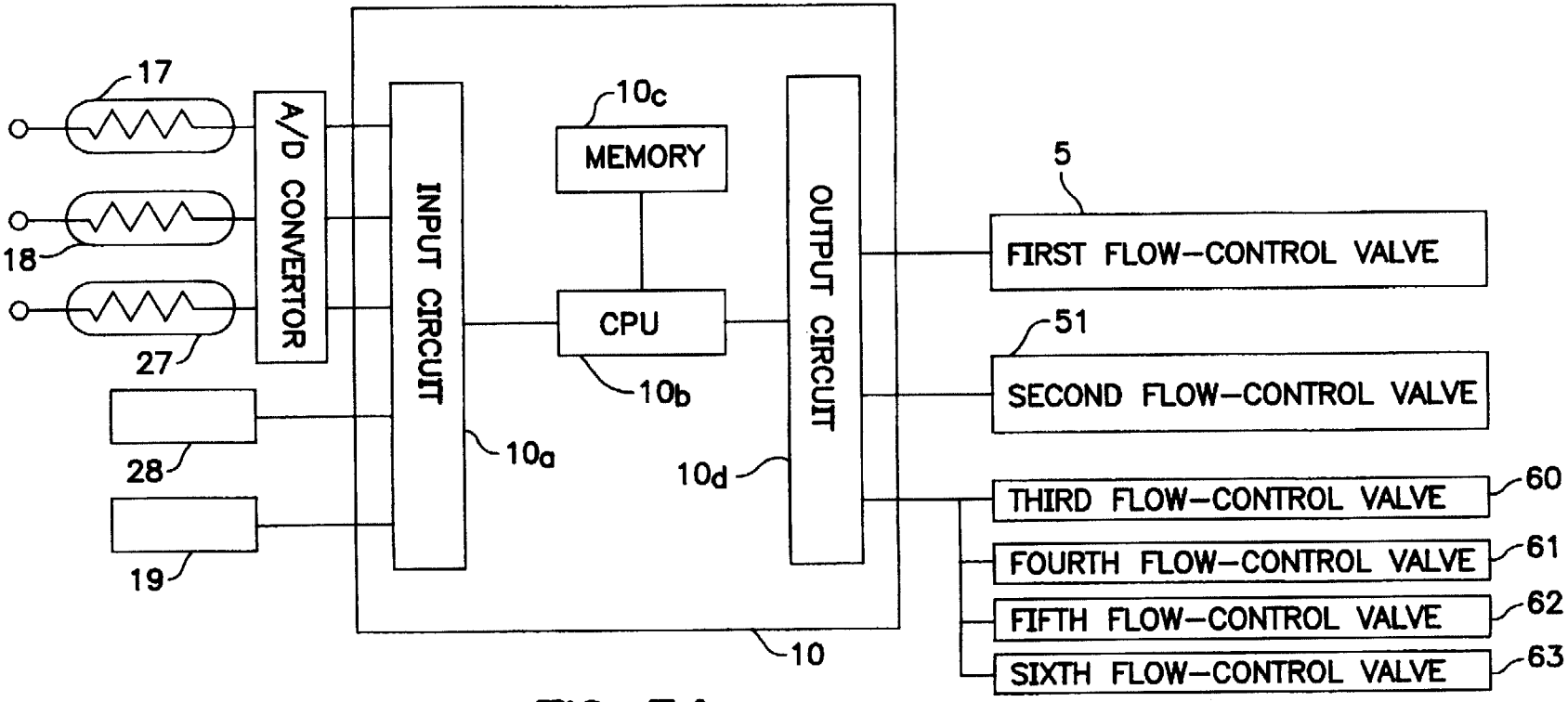
FIG. 34 shows a block diagram of the control circuit provided in the controller in accordance with the ninth exemplary embodiment of the present invention.
Figure 35:
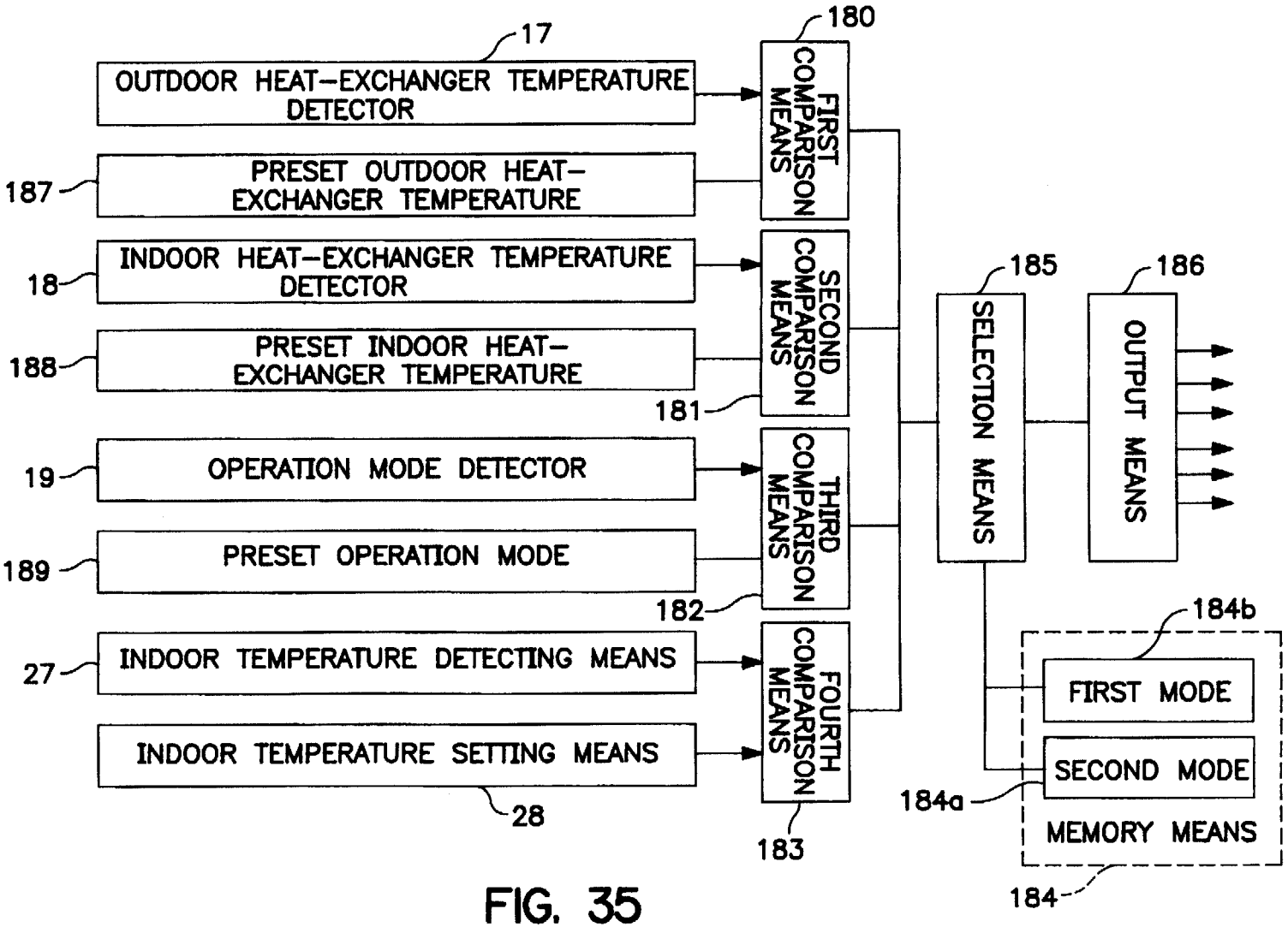
FIG. 35 shows a block diagram of the controller in accordance with the ninth exemplary embodiment of the present invention.

As shown in FIG. 33 to FIG. 35, flow-controller 67 is comprised of a first 180 and second comparison means 181 which are the same as those shown in Embodiment-2, a second, third 182 and fourth 183 comparison means which are the same as those shown in Embodiment-8, selection means 185 for selecting one of the modes memorized in the memory means 184 with a first mode 184*a* and a second mode 184*b* by the output signals generated by first to fourth comparison means 186, and an output means for outputting signals for the selection according to the signals from the first to fourth comparison means and for controlling the openings of the first to sixth flow-control valves. Preset outdoor heat exchanger temperature is represented by reference numeral 187, preset indoor heat exchanger temperature is represented by reference numeral 188, and preset operation mode is represented by reference numeral 189.

Figure 36:
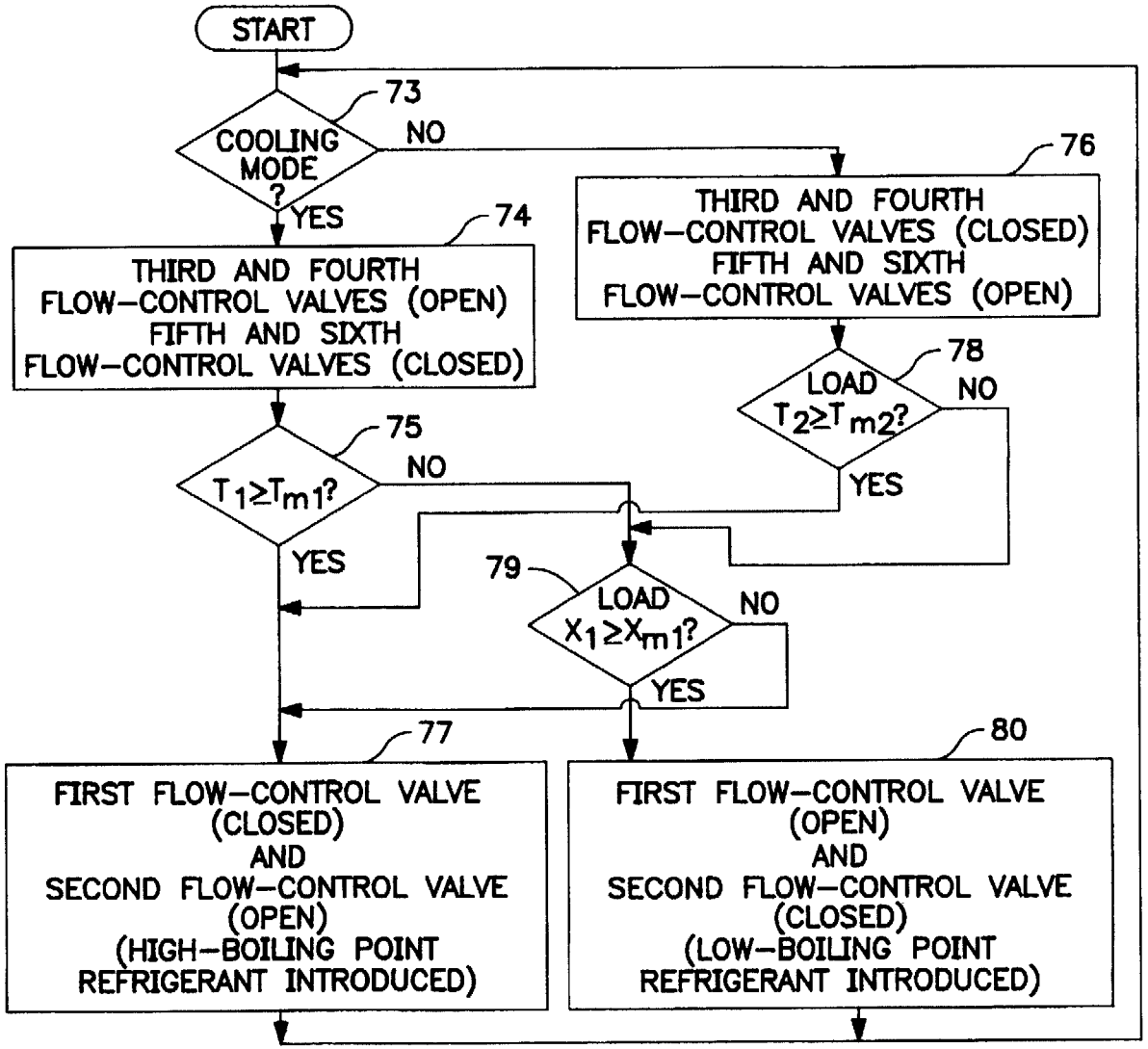
FIG. 36 shows a flow-chart explaining the operation of the controller in accordance with the ninth exemplary embodiment of the present invention.
Figure 37:
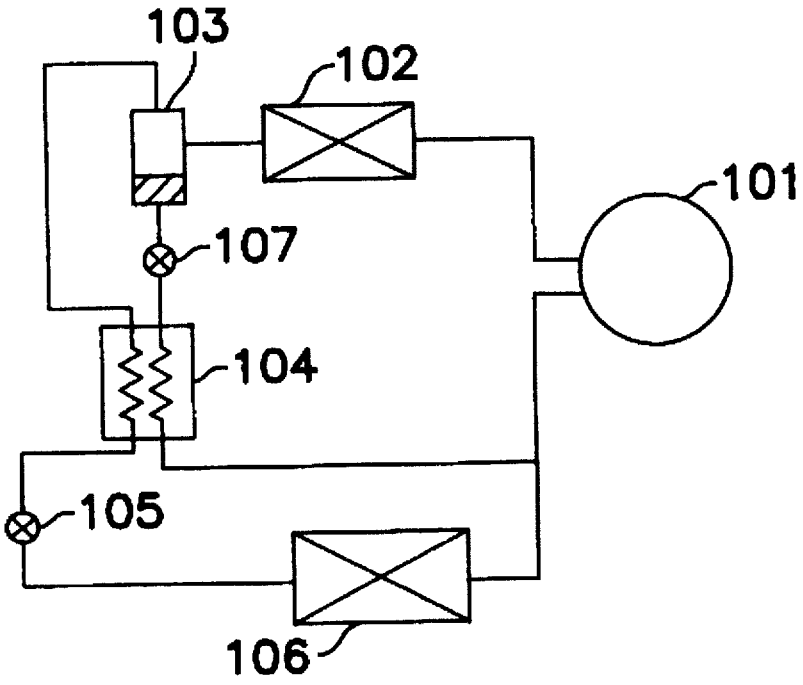
FIG. 37 PRIOR ART
FIG. 37 shows a refrigerating cycle diagram of a conventional refrigerator in accordance with the prior art.

The operation of thus constituted controller is now explained by referring to FIG. 36. As seen from the flow-chart shown in FIG. 36, first through sixth flow-control valves 60 to 63 are controlled in a wide operation range in order to realize safe and optimum COP.

When a start operation command is made by a remote-controller or a command of forced operation is made, the operation of the refrigerator is started, and at the same time, Step-73 shown in FIG. 36 is executed. If the output of operation mode detector 19 shows [cooling], [YES] is judged and processing continues at Step-74. In Step-74, a control signal is outputted from output-circuit 10*d*, thereby setting the third and fourth flow-control valves 60 and 61 to [ON], fifth and sixth flow-control valves 62 and 63 are set to [OFF], and processing continues at Step-75. If it is [heating], [NO] is judged, and processing continues at Step-76.

In Step-76, a control signal is outputted from output circuit 10*d*, third and fourth flow-control valves 60 and 61 are set to [OFF], and processing continues at Step-78. In Step-75, a difference operation for comparing the temperature $T_5$ detected by outdoor heat-exchanger temperature detecter 17 with preset temperature $T_{M5}$ (e.g., −65° C.) is conducted, and if a relation of $T_5 \geqq T_{M5}$ is found, [YES] is judged, and processing continues at Step-77.

In Step-77, the first output mode memorized in the memory means is selected by means of the selection means incorporated in memory 10*c*, a control signal is outputted from output circuit 10*d*, and first flow-control valve 5 is set to [OFF] and second flow-control valve 51 is set to [ON], and processing continues at Step-79. In Step-79, a difference operation for comparing the temperature $T_{M7}$ (or the temperature set by remote-controller) detected by indoor temperature setter 28 with the temperature $T_7$ detected by indoor temperature detector 27 is conducted in order to derive the indoor-load $X_4$, and if a relation of $X_4 \geqq X_{M4}$ is obtained from a comparison operation comparing indoor-load $X_4$ with preset-load $X_{M4}$ (e.g., 4000 W), [YES] is judged, and processing continues at Step-80.

In Step-80, the first output mode memorized in the memory means is selected by a selection means incorporated in memory 10*c*, a control signal is outputted from output circuit 10*d*, first flow-control valve 5 is set to [ON] and second flow-control valve 51 is set to [OFF], and processing returns to Step-73. If a relation of $X_4 < X_{M4}$ is found, [NO] is judged, and processing continues at Step-77, then Step-73. In Step-78, if a relation of $T_6 \geqq T_{M6}$ is found as a result of comparison operation comparing the temperature $T_6$ detected by indoor heat-exchanger temperature detector 18 with the preset temperature (e.g., 65° C.), [YES] is judged, and processing continues at Step-77 and then Step 73. If $T_6 < T_{m6}$ is found, [No] is judged, and processing continues at Step-79.

Each of these steps are now explained. Step-73 is a step to judge if it is [cooling] or [heating]. In Step-74, the third to sixth flow-control valves 60 to 63 are controlled to construct a cooling cycle, and in Step-76, the third to sixth flow-control valves 60 to 63 are controlled to construct a heating cycle. In Step-75, a comparison operation for determining if the outdoor heat-exchanger temperature is higher than the predetermined value from the preset outdoor heat-exchanger temperature is executed, and Step-78 executes a comparison operation for determining if the indoor heat-exchanger temperature is higher than the predetermined value from the preset indoor heat-exchanger temperature. In Step-79, a comparison operation for determining if indoor load is greater than the preset value from the preset indoor temperature and the indoor temperature is executed.

In Step-77, a control signal for introducing a refrigerant containing the high-boiling point component at a high ratio by setting first flow-control valve 5 to [OFF] and second flow-control valve 51 to [ON] is outputted. In Step-80, a control signal for introducing a refrigerant containing the low-boiling point component at a high ratio is outputted.

As explained above, an optimum refrigeration-cycle of high and safe COP according to the indoor load can be obtained by providing overhead condenser 26 on the top of fractionator 3 and reheater 4 at the bottom of the same, four-way valve 19, and indoor and outdoor heat-exchanger temperature detectors 16 and 15, respectively, and by controlling the first to sixth flow-control valves in accordance to the indoor load.

As seen from these embodiments of the invention, the first exemplary embodiment applied to the refrigerator controller of the invention comprises a reheater, a temperature detecting means on the condenser, and a flow-control valve controlling the flow of refrigerant according to the condenser temperature, and by this, abnormal increases of condenser pressure can be detected and avoided.

The second exemplary embodiment comprises a four-way valve, reheater, respective temperature detecting means to the indoor and outdoor heat-exchangers, and a flow-control valve controlling the flow of refrigerant according to the indoor and outdoor heat-exchanger temperatures, and by this, abnormal increases of condenser pressure become detectable and avoidable.

The third exemplary embodiment comprises the employment of a refrigerant consisting of R32/R125/R134 refrigerants mixed at a weight ratio of (23/25/52) and the provision of a four-way valve, overhead condenser, indoor temperature setting means, indoor temperature detecting meansn, and a flow-control valve controlling the flow according to preset indoor temperature and indoor temperature, and by this, an optimum refrigerating cycle quickly matched to the required load can be realized and the amenity can be improved.

The fourth exemplary embodiment comprises an outdoor heat exchanger temperature detecting means and a flow control-valve controlling the flow of refrigerant according to the preset indoor temperature and the indoor temperature in addition to the the third exemplary embodiment, and by this, an optimum refrigerating cycle matched to the required load can be quickly realized and the amenity can be improved.

The fifth exemplary embodiment comprises a second flow-control valve and a reheater on the bottom of fractionator mentioned in the fourth exemplary embodiment, and first and second flow-control valves operated according to the preset indoor-temperature and the indoor temperature. By this, a refrigerant containing a low-boiling point component at a high composition ratio can be introduced at a time of high load so that a mixed refrigerant showing quasi-azeotropic characteristics can be circulated. Therefore, by circulating a refrigerant containing a high-boiling point component at a high composition ratio at the time of low load while avoiding the frosting of condenser, an optimum refrigerating cycle quickly matched to the required load securing a safe and wide-range control capability can be realized.

The sixth exemplary embodiment comprises an overhead condenser, first flow-control valve, reheater, second flow-control valve, an indoor temperature setting means, and an indoor temperature detecting means, where the flow-control of the first and second flow-control valves is performed according to the preset indoor temperature and the indoor temperature. By this, an optimum refrigerating cycle matched to the required load can be realized while saving a considerable amount of energy.

The seventh exemplary embodiment is obtained by providing a condenser temperature detecting means according to the sixth exemplary embodiment, and the controlling of the first and second flow-control valves is made according to the preset indoor temperature, detected indoor temperature, and the condenser temperature. By this, abnormal condenser pressure increases can be detected and can be avoided, realizing an optimum refrigerating cycle matched to the required load.

The eighth exemplary embodiment is obtained by providing a four-way valve and third to sixth flow-control valves switching the flow of refrigerant according to the sixth exemplary embodiment. By this, an optimum refrigerating cycle matched to the required load can be realized in a wide refrigerating operation range while saving the energy.

The ninth exemplary embodiment is obtained by providing indoor and outdoor heat-exchanger temperature detecting means according to the eighth exemplary embodiment, and by controlling the first to the sixth flow-control valves according to the indoor and outdoor temperatures and outdoor heat-exchanger temperature. By this, while securing safety, an optimum refrigerating cycle matched to the required load in a wider operation range while saving the energy can be realized.

The tenth exemplary embodiment is obtained by employing a mixed non-azeotropic refrigerant consisting of more than two refrigerant types selected from R32, R125, and R134a as the refrigerant of the sixth, seventh, eighth, or ninth exemplary embodiment. By this, an optimum refrigerating cycle obtaining a refrigeration capability that is the same as that obtained by R22 can be realized.

The eleventh exemplary embodiment is obtained by employing a non-azeotropic refrigerant obtained by mixing R32, R125 and R134a refrigerants at a weight ratio of 23/25/52% as the refrigerant of the sixth, seventh, eighth or ninth exemplary embodiment. By this, a refrigerating cycle securing COP equivalent to that available by R22 can be realized.

The twelfth exemplary embodiment is obtained by employing a non-azeotropic refrigerant consisting of R32, R125, and R134a refrigerants mixed at a weight ratio of 45/45/10% as the refrigerant of the sixth, seventh, eighth, or ninth exemplary embodiment. By this, a refrigerating cycle securing COP higher than that available by R22 can be realized.

Although illustrated and described hereinwith reference to certain specific embodiments, the present invention is nevertheless not intended to be limited to the details shown. Rather, various modification may be made in the details within the scope and range of equivalents of the claims and without departing from the spirit of the invention.

What is claimed is:

1. A refrigerator controller employing a non-azeotropic refrigerant comprising:

a compressor, condenser, fractionator, reheater, flow-control valve, and an evaporator which are ring-connected, means for separating the refrigerant evaporated by said reheater, comparison means for comparing temperature of the condenser with a preset condenser-temperature and outputting a control signal indicative of the result of said comparison, memory means for memorizing a plurality of output modes controlling opening of said flow-control valve, selection means for selecting one of the output modes memorized in said memory means responsive to the control signal, and flow-control valve controlling means for controlling the opening of said flow-control valve responsive to the control signal.

2. A refrigerator controller employing a non-azeotropic refrigerant comprising:

a compressor, four-way valve, outdoor heat-exchanger, fractionator, reheater, flow-control valve, and an indoor heat-exchanger which are ring-connected, means for separating said refrigerant evaporated by said reheater, indoor heat-exchanger temperature detecting means for detecting an indoor heat-exchanger temperature and an outdoor heat-exchanger temperature detecting means for detecting an outdoor heat-exchanger temperature, operation-mode detecting means for detecting an operation-mode, first comparison means for comparing temperature of the outdoor heat-exchanger with a preset outdoor heat-exchanger temperature and outputting a control signal indicative of the result of said comparison, second comparison means for comparing temperature of the indoor heat-exchanger with a preset indoor heat-exchanger temperature and outputting a control signal indicative of the result of said comparison, third comparison means for comparing the operation-mode detected by said operating mode detecting means with a preset operating mode, memory means for memorizing an output-mode controlling opening of said flow-control valve, and flow-control valve controlling means for controlling the opening of said flow-control valve responsive to the signals from said first to third comparison means.

3. A refrigerator controller employing a non-azeotropic refrigerant obtained by mixing R32/R125/R134a refrigerants at a weight ratio of 23/25/52 comprising:

a compressor, four-way valve, outdoor heat-exchanger, fractionator, overhead condenser, flow-control valve, and an indoor heat-exchanger which are ring-connected, means for separating said refrigerant evaporated by said reheater, indoor heat-exchanger temperature setting means for setting an indoor temperature at a desired temperature, operation-mode detecting means for detecting the operation-mode, third comparison means for comparing said operation-mode detected by said operation-mode detecting means with a preset operating mode, difference-temperature detecting means for deriving a temperature-difference between the indoor-temperature and an outdoor-temperature by the signals from said indoor-temperature detecting means and a preset indoor-temperature, indoor-load deriving means for deriving an indoor-load from said temperature-difference, fourth comparison means for comparing the value derived by said indoor-load deriving means with a preset load value and outputting a comparison signal, memory means for memorizing a plurality of output-modes controlling opening of said flow-control valve, and selection means for selecting one of the output modes memorized in said memory means responsive to the control signal, wherein opening of said flow-control valve is controlled by the signals from said third and fourth comparison means.

4. A refrigerator controller employing a non-azeotropic refrigerant obtained by mixing R32/R125/R134a refrigerants at a weight ratio of 23/25/52 comprising:

a compressor, four-way valve, outdoor heat-exchanger, fractionator, overhead-condenser, flow-control valve, and an indoor heat-exchanger which are ring-connected, means for separating said refrigerant evaporated by said reheater, outdoor heat-exchanger temperature detecting means for detecting a temperature of said outdoor heat-exchanger, indoor heat-exchanger temperature detecting means for detecting a temperature of said indoor heat-exchanger, indoor temperature detecting means for detecting an indoor temperature, indoor-temperature setting means for setting the indoor-temperature at a desired temperature, operation-mode detecting means for detecting an operation-mode, first comparison means for comparing temperature of said outdoor heat-exchanger with a preset outdoor heat-exchanger temperature and outputting a control signal indicative of the result of said comparison, second comparison means for comparing temperature of said indoor heat-exchanger with a preset indoor heat-exchanger temperature and outputting a control signal indicative of the result of said comparison, third comparison means for comparing the operation-mode detected by said operation mode detecting means with a preset operation-mode, difference temperature detecting means for deriving the temperature-difference between the indoor-temperature and the preset indoor-temperature from the signals from said indoor-temperature detecting means and the indoor-temperature setting means, indoor-load deriving means for deriving a indoor-load from said temperature-difference, fourth comparison means for comparing the value derived by said indoor-load deriving means with a preset-load value and outputting a comparison signal indicative of the result of said comparison, memory means for memorizing a plurality of output-modes controlling opening of said flow-control valve, and selection means for selecting one of the output-modes memorized in said memory means responsive to the control signal generated by said first to fourth comparison means, wherein opening of said flow-control valve is controlled by the signals obtained from said first to said fourth comparison means.

5. A refrigerator controller employing a non-azeotropic refrigerant obtained by mixing R32/R126/R134a refrigerants at a weight ratio of 23/25/52 comprising:

a compressor, four-way valve, outdoor heat-exchanger, fractionator, overhead-condenser, first flow-control valve, and an indoor heat-exchanger which are ring-connected, means for separating said refrigerant evaporated by said overhead condenser, means for connecting said reheater to the bottom of said fractionator through a second flow-control returning the refrigerant evaporated by said reheater to the bottom of said fractionator, outdoor heat-exchanger temperature detecting means for detecting a temperature of said outdoor heat exchanger, indoor heat-exchanger temperature detecting means for detecting a temperature of said indoor heat-exchanger, indoor temperature setting means for setting an indoor temperature at a desired temperature, operation mode detecting means for detecting an operation mode, first comparison means for comparing temperature of the outdoor heat-exchanger with a preset outdoor heat-exchanger temperature and outputting a control signal indicative of the result of said comparison, second comparison means for comparing temperature of said indoor heat-exchanger with a preset indoor heat-exchanger temperature and outputting a control signal indicative of the result of said comparison, third comparison means for comparing the operation mode detected by said operation mode detecting means with a preset operation mode, difference temperature detecting means for determining the temperature difference between the indoor-temperature and the preset indoor-temperature from the signals of said indoor temperature detecting means and the indoor temperature setting means, fourth comparison means for comparing the value derived by indoor-load deriving means deriving with a preset load value, memory means for memorizing a plurality of output modes controlling openings of said first and second flow-control valves, and selection means for selecting one of the output modes memorized in said memory means responsive to the control signals obtained from said first to fourth comparison means, wherein openings of said first and second flow-control valves are controlled by the signals obtained from said first to fourth comparison means.

6. A refrigerator controller employing a non-azeotropic refrigerant comprising:

a compressor, condenser, fractionator, overhead-condenser, first flow-control valve, and an evaporater which are ring-connected, means for separating said refrigerant evaporated by said overhead condenser, means for separating refrigerant evaporated by said reheater, indoor temperature detecting means for detecting the indoor temperature, indoor temperature setting means for setting the indoor temperature at a desired temperature, difference temperature detecting means for detecting the difference between the indoor temperature and preset indoor temperature from the signals from said indoor temperature detecting means and said indoor temperature setting means, indoor load deriving means for deriving the indoor load from said difference temperature, fourth comparison means for comparing the value derived by said indoor load deriving means deriving the indoor load from said difference temperature with the preset load value, and outputting a control signal indicative of the result of said comparison, memory means for memorizing a plurality of output modes controlling openings of said first and second flow-control valves, and selection means for selecting one of the output modes memorized in said memory means responsive to the control signal, wherein openings of said first and second flow-control valves are controlled by the signal obtained from said fourth comparison means.

7. A refrigerator controller employing a non-azeotropic refrigerant, comprising:

a compressor, condenser, fractionator, overhead-condenser, first flow-control valve, and an evaporater which are ring-connected, means for separating said refrigerant evaporated by said overhead condenser, means for separating refrigerant evaporated by said reheater provided on the bottom of said fractionator, condenser temperature detecting means for detecting the temperature of said condenser, indoor temperature detecting means for detecting the indoor temperature, indoor temperature setting means for setting the indoor temperature at a desired temperature, first comparison means for comparing temperature of the condenser with the preset condenser temperature and outputting a control signal indicative of the result of said comparison, difference temperature detecting means for detecting the difference between the indoor temperature and preset indoor temperature from the signals from said indoor temperature detecting means and said indoor temperature setting means, indoor load deriving means for deriving the indoor load from said difference temperature, fourth comparison means for comparing the value derived by said indoor load deriving means deriving the indoor load from said difference temperature with the preset load value and outputting a control signal indicative of the result of said comparison, memory means for memorizing a plurality of output modes controlling openings of said first and second flow-control valves, and selection means for selecting one of the output modes memorized in said memory means responsive to the control signal, wherein openings of said first and second flow-control valves are controlled by the signal obtained from said first and fourth fourth comparison means.

8. A refrigerator controller employing a non-azeotropic refrigerant comprising:

a compressor, four-way valve, outdoor heat-exchanger, second throttle device, third flow-control valve, fractionator, overhead-condenser, first flow-control valve, fourth flow-control valve, first throttle device and an indoor heat exchanger which are ring-connected, means for separating said refrigerant evaporated by said overhead condenser, means for separating said refrigerant evaporated by said reheater provided on the bottom of said fractionator, means for connecting said second throttle device to said third flow-control valve connected to means connecting said first flow-control valve to said fractionator through fifth flow-control valve, means for connecting said third flow-control valve to fractionator and means for connecting said fourth flow-control valve to said first throttle device connected through sixth flow-control valve, indoor-temperature detecting means for detecting the indoor temperature, indoor temperature setting means for setting the indoor temperature at a desired temperature, operation-mode detecting means for detecting the operation-mode, third comparison means comparing the value detected by said operation-mode detecting means with the operation-mode, difference-temperature for detecting means detecting the difference between the indoor-temperature and preset indoor temperature from the signals from said indoor temperature detecting means and said indoor-temperature setting means, indoor-load deriving means for deriving the indoor load from said difference-temperature, fourth comparison means for comparing the value derived by said indoor-load deriving means deriving the indoor-load from said difference temperature with the preset load value and outputting a comparison signal indicative of the result of said comparison, memory means for memorizing a plurality of output modes controlling openings of said first to sixth flow-control valves, and selection means for selecting one of the output modes memorized in said memory means responsive to the control signals obtained from said third and fourth comparison means, wherein openings of said first to sixth flow-control valves are controlled by the signal obtained from said third and fourth comparison means.

9. A refrigerator controller employing a non-azeotropic refrigerant comprising:

a compressor, condenser, four-way valve, outdoor heat-exchanger, second throttle device, third flow-control valve, fractionator, overhead-condenser provided, first flow-control valve, fourth flow-control valve, first throttle device, and an indoor heat exchanger which are ring-connected, means for separating said refrigerant liquidized by said overhead-condenser, means for separating said refrigerant evaporated by said reheater provided on the bottom of said fractionator, means for connecting said second throttle device to said third flow-control valve connected to means for connecting said first flow-control valve to said fourth flow-control valve through fifth flow-control valve, means for connecting said third flow-control valve to said fractionator and means for connecting from said fourth flow-control valve to said first throttle device connected through sixth flow-control valve, indoor heat-exchanger temperature detecting means for detecting the indoor heat-exchanger temperature, indoor-temperature detecting means for detecting the indoor temperature, indoor temperature setting means for setting the indoor temperature at a desired temperature, operation-mode detecting means for detecting the operation-mode, first comparison means for comparing temperature of the outdoor heat-exchanger with the preset outdoor heat-exchanger temperature and outputting a control signal indicative of the result of said comparison, second comparison means for comparing temperature of the indoor heat-exchanger with the preset indoor heat-exchanger temperature detecting means with the preset outdoor heat-exchanger temperature and outputting a control signal indicative of the result of said comparison, third comparison means for comparing the valve detected by said operation-mode detecting means with the operation-mode, difference-temperature detecting means for detecting the difference between the indoor-temperature and the preset indoor-temperature from the signals from said indoor-temperature detecting means and said indoor-temperature setting means, indoor-load deriving means for deriving the indoor-load from said difference-temperature, fourth comparison means for comparing the value derived by said indoor-load deriving means with the preset load value and outputting a comparison signal indicative of the result of said comparison, memory means for memorizing a plurality of output-modes controlling openings of said first to sixth flow-control valves, and selection means for selecting one of the output-modes memorized in said memory means responsive to the control signals from said first to fourth comparison means, wherein openings of said first to sixth flow-control valves are controlled by the signals obtained from said first to fourth comparison means.

10. A refrigerator controller according to claim 6 employing a mixed non-azeotropic refrigerant consisting of more than two types of refrigerants selected out of R32, R125 and R134a refrigerants.

11. A refrigerator controller according to claim 6 employing a mixed non-azeotropic refrigerant consisting of R32, R125 and R134a refrigerants mixed at a weight-ratio of 23/25/52.

12. A refrigerator controller according to claim 6 employing a mixed non-azeotropic refrigerant consisting of R32, R125, and R134a refrigerants mixed at a weight ratio of 45/45/10.

13. A refrigerator controller according to claim 7 employing a mixed non-azeotropic refrigerant consisting of more than two types of refrigerants selected out of R32, R125 and R134a refrigerants.

14. A refrigerator controller according to claim 8 employing a mixed non-azeotropic refrigerant consisting of more than two types of refrigerants selected out of R32, R125 and R134a refrigerants.

15. A refrigerator controller according to claim 9 employing a mixed non-azeotropic refrigerant consisting of more than two types of refrigerants selected out of R32, R125 and R134a refrigerants.

16. A refrigerator controller according to claim 7 employing a mixed non-azeotropic refrigerant consisting of R32, R125 and R134a refrigerants mixed at a weight-ratio of 23/25/52.

17. A refrigerator controller according to claim 8 employing a mixed non-azeotropic refrigerant consisting of R32, R125 and R134a refrigerants mixed at a weight-ratio of 23/25/52.

18. A refrigerator controller according to claim 9 employing a mixed non-azeotropic refrigerant consisting of R32, R125 and R134a refrigerants mixed at a weight-ratio of 23/25/52.

19. A refrigerator controller according to claim 7 employing a mixed non-azeotropic refrigerant consisting of R32, R125, and R134a refrigerants mixed at a weight ratio of 45/45/10.

20. A refrigerator controller according to claim 8 employing a mixed non-azeotropic refrigerant consisting of R32, R125, and R134a refrigerants mixed at a weight ratio of 45/45/10.

21. A refrigerator controller according to claim 9 employing a mixed non-azeotropic refrigerant consisting of R32, R125, and R134a refrigerants mixed at a weight ratio of 45/45/10.

* * * * *